US005997386A

United States Patent [19]

Dumond, Jr. et al.

[11] Patent Number: 5,997,386

[45] Date of Patent: Dec. 7, 1999

[54] AUTOMATED DEBURRING ASSEMBLY

[75] Inventors: Harvey Dumond, Jr.; Timothy S. Jaspers; Douglas William Vanderwell, all of Hudsonville, Mich.

[73] Assignee: Pridgeon & Clay, Inc., Grand Rapids, Mich.

[21] Appl. No.: 08/991,379

[22] Filed: Dec. 16, 1997

[51] Int. Cl.[6] ..... B24B 1/00

[52] U.S. Cl. ..... 451/57; 451/296; 451/299

[58] Field of Search ..... 451/57, 28, 41, 451/42, 58, 63, 296, 299, 300, 302, 303, 111, 112, 259, 262, 168

[56] References Cited

U.S. PATENT DOCUMENTS

| | | | |
|---|---|---|---|
| 3,769,754 | 11/1973 | Ixer . | |
| 3,847,271 | 11/1974 | Culley . | |
| 3,888,050 | 6/1975 | Elm | 451/57 |
| 3,991,522 | 11/1976 | Hedlund . | |
| 4,280,304 | 7/1981 | Kobayashi . | |
| 4,384,433 | 5/1983 | Van Der Linden | 451/300 |
| 4,416,090 | 11/1983 | Jonasson | 451/300 |
| 4,594,815 | 6/1986 | Mickelson . | |
| 4,601,134 | 7/1986 | Hessemann | 451/300 |
| 4,719,721 | 1/1988 | Stump . | |
| 4,843,764 | 7/1989 | Bando . | |
| 5,220,750 | 6/1993 | Emberland et al. | 451/300 |
| 5,276,999 | 1/1994 | Bando, II . | |
| 5,443,414 | 8/1995 | Naney | 451/57 |
| 5,702,287 | 12/1997 | Haney | 451/57 |

*Primary Examiner*—David A. Scherbel
*Assistant Examiner*—Derris Holt Banks
*Attorney, Agent, or Firm*—Barry C. Kane of Miller, Johnson, Snell & Cummiskey, PLC

[57] ABSTRACT

An apparatus for abrading or deburring a workpiece is provided and includes in combination a conveyor for moving the workpiece from a first position to a second position and at least two assemblies intermediate the first and second positions and opposite the conveyor for abrading one side of the workpiece in a plurality of directions. In an alternate embodiment of the invention, a third assembly may be provided which deburrs an opposite side of the workpiece as it is passed through the deburring assembly. The conveyor for moving the workpiece positively fixes the location of the workpiece with respect to the conveyor and translates the workpiece through the deburring assembly.

44 Claims, 15 Drawing Sheets

AUTOMATED DEBURRING ASSEMBLY

BACKGROUND OF THE INVENTION

Historically, parts or components stamped from sheets or ribbons of steel were hand-ground to remove sharp edges and burrs produced during the stamping process. Later, with the advent of power equipment, workers individually removed sharp edges and burrs from the stamped products using grinding and wire wheels. Although the advent of the power equipment expedited the process, parts or components were still being worked on individually on a piece-by-piece basis by a worker in a factory.

Continued technological advances in machinery, stamped components of the same pattern or design were stacked in magazines wherein a shuttle would remove a part from an end of the magazine and slide the component along the surface of a grinding belt to deburr the surface of the component facing the grinding belt surface. Water would be sprayed on the components as they pass along the belt to act as a coolant and remove the swarf from the belt during the process. At the end of the process, the component was discharged onto a ramp where the component was then stacked manually by the operator so the components could be moved on to the next station.

A disadvantage with this process was that the shuttle placed no force on the component which was perpendicular to the direction of travel to ensure that the component had been fully deburred. Because the grinding belt ran in a direction opposite to the translation followed by the shuttle, occasionally the component would be rocked up on edge such that deburring occurred only along a portion of the surface rather than along the entire lower surface. This resulted in poor quality and the occasional need to reverse the orientation of the part in the magazine to deburr the side that was missed. Furthermore, occasionally components would slide under the shuttle, either causing a jam of the grinding belt and ultimate destruction of the belt, or colliding with the subsequent component and cause a disruption of the grinding process. Furthermore, the parts or components needed to be loaded in a magazine which required manual labor and reduced the efficiency and throughput of the components through the grinding machine.

Accordingly, there has been a long-felt yet unresolved need to produce a machine which efficiently and thoroughly deburrs the entire surface of a stamped product wherein the components are positively retained and moved through the grinding process and wherein the production rate is substantially uninterrupted as a result of an operator need to load magazines and the like. The assembly described below, and embodying the invention, satisfies this need.

SUMMARY OF THE INVENTION

In view of the disadvantages of the prior devices, the apparatus embodying the instant invention includes a conveyor for moving the workpiece from a first position to a second position and a first assembly intermediate the first and second positions and opposite the conveyor for abrading at least one side of the workpiece in a first direction. In addition, a second assembly is provided intermediate the first and second positions and opposite the conveyor for abrading the one side of the workpiece in at least one direction different from that of the first direction provided by the first assembly.

In another form of the invention, the assembly for abrading the workpiece includes at least one continuous loop conveyor belt assembly having a plurality of biased fingers extending outwardly therefrom for contacting the workpiece and translating the workpiece from an input position to an output position. A first assembly is provided intermediate the input and output positions and located opposite the continuous loop conveyor belt assembly for abrading the workpiece in a first direction as the continuous loop conveyor belt assembly translates the workpiece from the input position toward the output position. A second assembly is provided opposite the continuous loop conveyor belt and intermediate the input and output positions for abrading the workpiece in a direction different from that achieved by the first assembly as the continuous loop conveyor belt assembly translates the workpiece from the input position toward the output position.

In yet another form of the invention, the apparatus includes a first continuous loop conveyor belt assembly having a plurality of biased fingers extending therefrom for contacting the workpiece and translating the workpiece from an input position toward an output position. A first abrasive assembly is located intermediate the input and output positions and disposed opposite the first continuous loop conveyor belt assembly for abrading one surface of the workpiece in a first direction as the first continuous loop conveyor belt assembly translates the workpiece from the input position toward the output position. A second abrasive assembly is disposed opposite the first continuous loop conveyor belt assembly and intermediate the input and output positions for abrading the one surface of the workpiece in a direction different from that of the first direction as the first continuous loop conveyor belt assembly translates the workpiece from the input position toward the output position. A second continuous loop conveyor belt assembly is disposed at a discharge end of the first continuous loop conveyor belt assembly and is oriented generally opposite thereto for translating the workpiece from the discharge position of the first continuous loop conveyor belt toward the output position. A third abrasive assembly is disposed opposite the second continuous loop conveyor belt assembly and intermediate the input and output positions for abrading an opposite surface of the workpiece as the second continuous loop conveyor belt assembly translates the workpiece from the discharge position toward the output position.

The method and apparatus of this invention provide several advantages and benefits over the prior methods and systems. The method and apparatus substantially improve the efficiency of the deburring process over an entire surface of the workpiece in contact with the abrading devices. Additionally, the positive engagement by the conveying systems urge the workpieces against the abrading surfaces so that the desired surface of the workpieces are exposed to the abrasive. In addition, instead of the abrasive working in a single direction as in the prior devices, the surface of each workpiece is exposed to abrasive action in multiple directions. The positive engagement by the conveying system also securely locates the workpiece with respect to the conveying device to prevent the workpiece from slipping or being dislocated by the abrading devices. This secure location of each workpiece through the deburring process also substantially improves the output of the deburring assembly. The conveying assembly also removes the requirement that the workpieces be contained in a magazine to dispense the components into the deburring assembly. Rather, the parts may be dumped onto a table wherein the operator locates each piece as they are placed on an inlet of the conveying system. These and other advantages provided by the invention may be obtained from the appended detailed description and drawing figures described below.

BRIEF DESCRIPTION OF THE DRAWING FIGURES

DETAILED DESCRIPTION OF THE DIFFERENT EMBODIMENTS

Figure 3A:
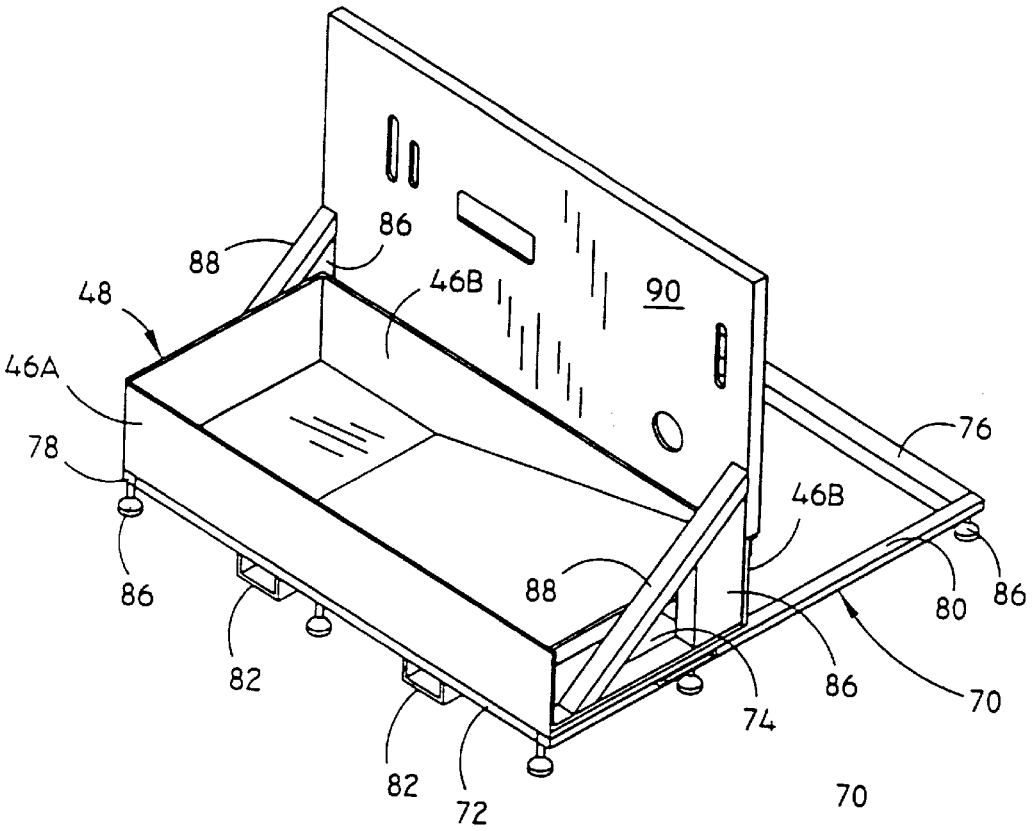
FIG. 3A is an isometric view of a frame assembly of the invention.
Figure 3B:
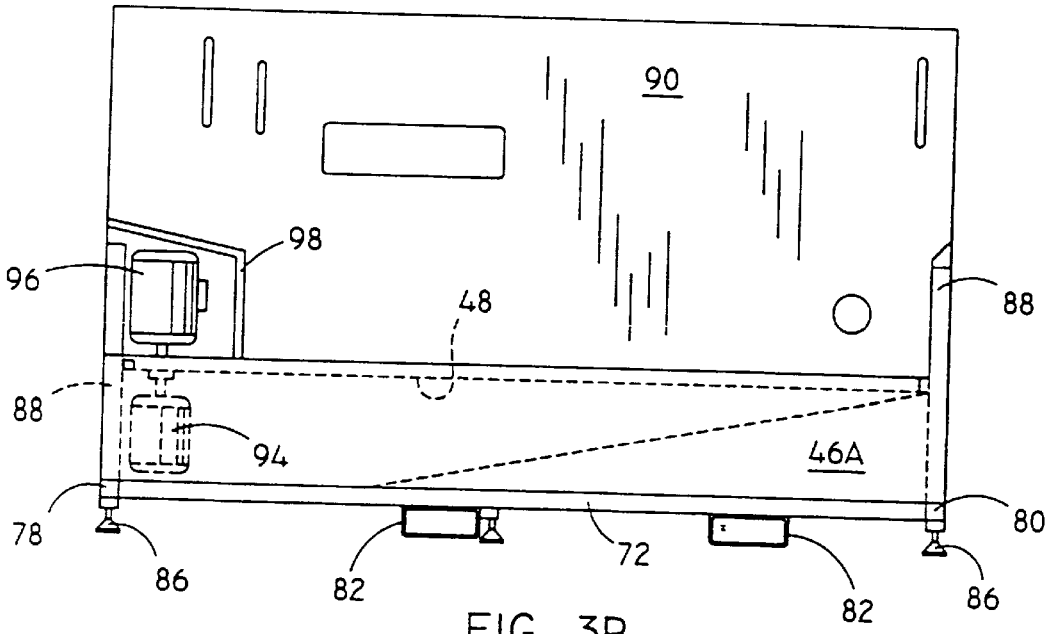
FIG. 3B is an elevation view of the frame assembly including a pump.

For the purposes of the following description, the terms "upper," "lower," "right," "left," "front," "rear," "vertical," "horizontal" and derivatives and formative thereof shall relate to the invention as oriented in FIG. 3. However, it is understood that the invention may assume various alternative configurations, except where expressly stated to the contrary. It is also clear that the stated devices and processes described in the following description and illustrated in the attached drawing figures are simply exemplary embodiments of the invention as defined in the appended claims. Any dimensions or physical characteristics related to one or more of the embodiments shall not be considered limiting unless the claims expressly state otherwise. For the convenience of the reader and a better understanding of the invention, like reference numerals will be used to indicate like components.

System in General

Figure 1:
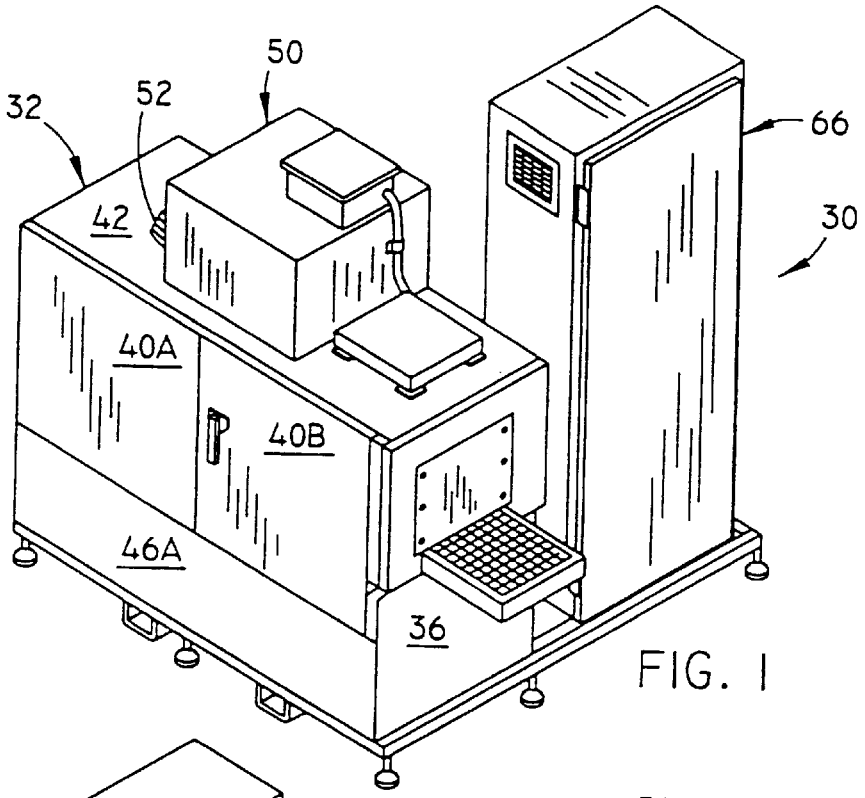
FIG. 1 is an isometric view of one form of an automatic deburring device embodying the invention.
Figure 2:
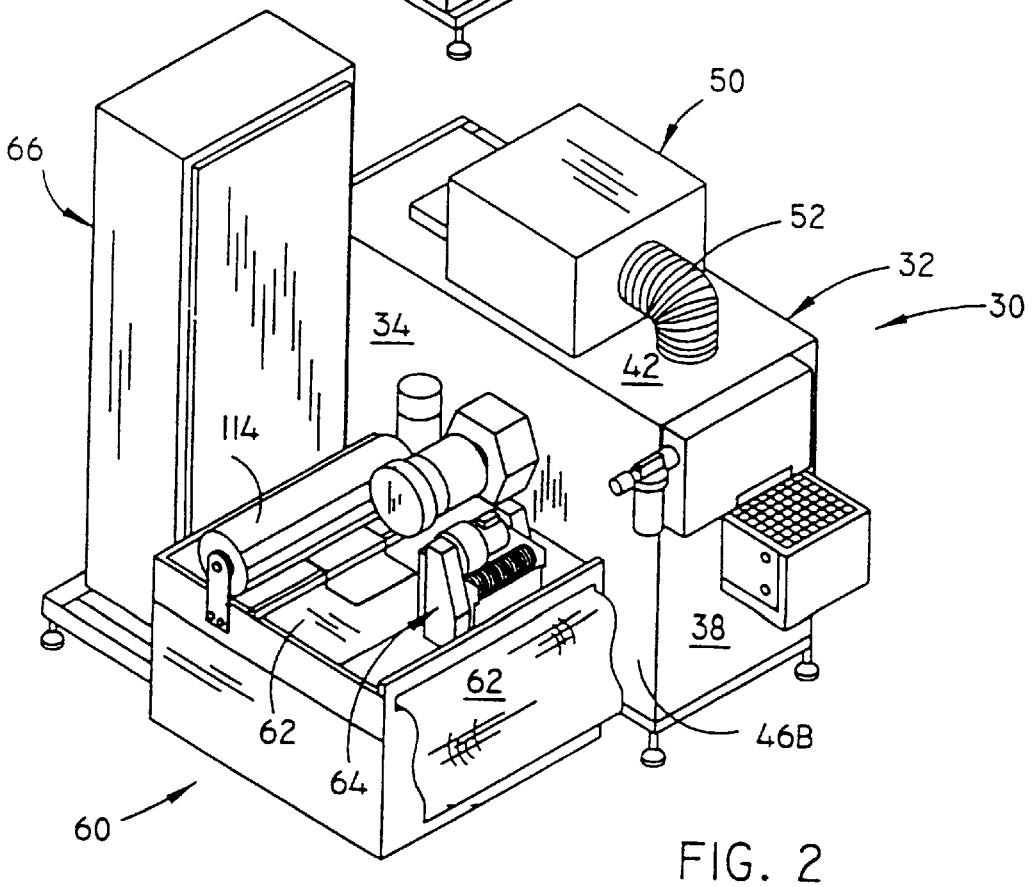
FIG. 2 is an isometric view of an opposite side of the automatic deburring device shown in FIG. 1.

Referring to FIGS. 1 and 2, the automated deburring assembly 30 embodying the invention is illustrated and includes a main cabinet 32 having a back wall 34, end walls 36 and 38, side doors 40A, 40B on a side opposite back wall 34, a top wall 42, and a bottom wall (not shown). Lower walls 46A and 46B are located below side doors 40A, 40B; and back wall 34, and in combination with end walls 36, 38, and back wall 32, form a substantial portion of a tank 48 (FIG. 3B) described in greater detail below. Disposed on top wall 42 is a mist collection device 50 coupled in fluid communication to the interior of cabinet 32 through a conduit 52. The mist collection device, such as Model No. 4E447 available from the Dayton Corp., creates a low pressure within cabinet 32 to prevent any mist within the cabinet 32 from escaping to the ambient air. Device 50 also draws ambient air in through any openings in the cabinet to keep fluid from leaking through the openings in the cabinet 32.

Located immediately adjacent the back wall 34 of the cabinet or in close proximity thereto is the filtering assembly 60. In the preferred embodiment, filtering assembly 60 is a conventional filtering assembly such as Model No. 1440 available from the Hyde Corp of Cleveland, Ohio, and used to physically remove cutting or filings (hereinafter "swarf") from the lubricating coolant. The filtering assembly 60 preferably includes a filter material 62 having a mesh size of 40$\mu$ through which the lubricating coolant passes to remove contaminants up to about 40$\mu$ in size. A magnetic drum assembly 64 disposed at one end of the filter assembly captures magnetic debris from the lubricant. The lubricating liquid passing over the drum assembly 64 and through the mesh filter media 62 is reintroduced into the main cabinet as will be described below. Located at one end of the filtering assembly 60, and adjacent or proximate end wall 36 is a control cabinet 66 which houses the power supply and a programmable logic control system for controlling the functions of the deburring assembly 30. Also housed within cabinet 66 may be pneumatic valves and/or a compressor for controlling various components in, and in association with, the deburring assembly 30.

Frame Assembly

The deburring assembly main cabinet 32, filter assembly 60, and control cabinet 66 are mounted on and supported by a frame assembly 70 (FIG. 3A, 3B) preferably constructed from square steel tubing to provide a sound and rigid structural base. Frame assembly 70 may include front 72, intermediate 74, and back 76 horizontal members interconnected at their ends by left and right horizontal end members 78 and 80, respectively. In addition, one or more rectangular tubes 82 may be located intermediate and parallel end members 78 and 80 and extend underneath, and connected to, horizontal members 72, 74 and 76, for receiving the forks of a fork lift truck or the like to move the assembly 30 if desired. Adjustable legs, such as 86 are provided at spaced locations from the lower side of the horizontal members to permit leveling of the assembly 30. A back portion of the horizontal frame assembly forms the base for the filter assembly 60 and the control cabinet 66 described above. Extending vertically from each end member 78 and 80 at a point proximate the intermediate horizontal member 74 is an upright 86. The top of each upright 86 is interconnected by a brace 88 to the front horizontal member 72 at a point where it is connected to the end members 78 and 80. A back plate 90, preferably made from steel, and having a thickness from about one-half inch to about one inch, is attached to and supported by the uprights 86 so that the plate extends vertically and forms the backbone or principal support for many of the components described below. The back plate is preferably attached by bolts (not shown) extending through each upright 86 and into the back plate 90. As better shown in FIGS. 3A, 3B, the back plate 90 contains several cut out sections which will be addressed in greater detail below, but generally, the cut outs are provided to permit access or accommodate components within the main cabinet 32. The frame assembly 70, including the back plate 90, form the skeleton for supporting the sheet metal sides or walls described above.

Circulatory System

Supported within and by the frame assembly 70 is tank 48 (FIG. 4) briefly mentioned above, formed in substantial part within the back plate 90, end walls 36 and 38, bottom wall 44, and lower walls 46A, 46B. In the preferred embodiment, a separate sheet metal enclosure rests within the framework defined above. A portion 92 of the bottom of the tank 48 is inclined with respect to the horizontal members, sloping downwardly from one end above the right end member 80, towards left end member 78, where it becomes substantially horizontal. The purpose of the sloping configuration is to form a sump for at least one pump 94 (FIG. 3B) positioned therein and driven by motor(s) 96. The tank 48 may contain a small housing 98 surrounding the motor(s) 96 to protect them from the splashing and dripping lubricating coolant.

Figure 4:
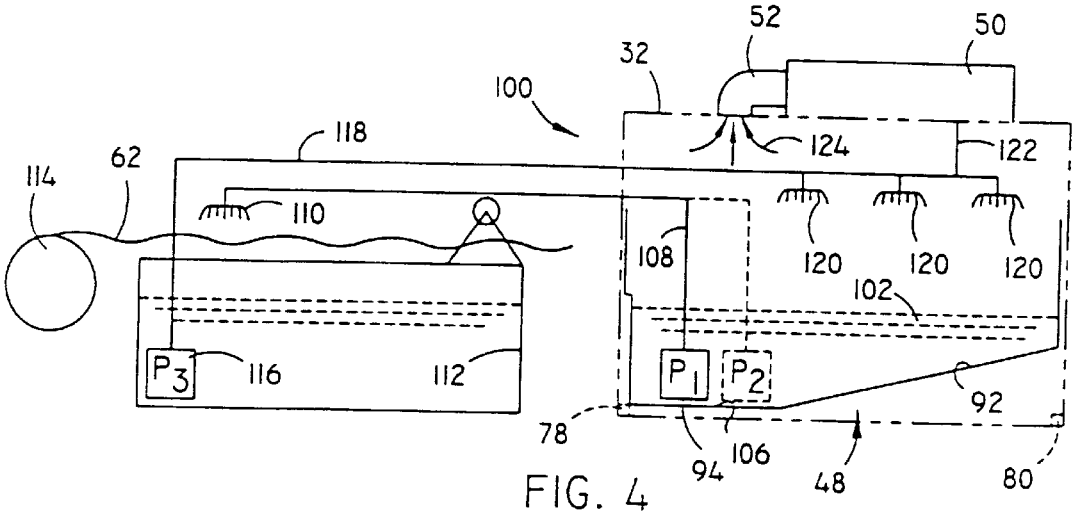
FIG. 4 is a schematic diagram of the circulation assembly of the invention.

Referring to FIG. 4, the schematic illustrates the circulatory system 100 within cabinet 32 which includes tank 48 retaining the lubricating coolant 102. At least one pump 94 is disposed within the sump 106 of the tank 48 and coupled to a conduit 108, a discharge end 110 of which empties into a tank 112 of the filter assembly 60. The discharge end 110 of the conduit 108 is positioned just above the filter media 62 so that any swarf, cuttings or filings contained within the coolant 102 are physically removed by the filter media. The filter media 62 is on a roll 114 so that it may be easily replaced as it becomes clogged. The clean coolant 102 is then collected in tank 112 where it is pumped by pump 116 through a conduit system 118 and discharged through a plurality of nozzles 120 at preferred locations within the cabinet 32 to lubricate the various components contained therein. The conduit assembly 118 is also coupled by a conduit 122 to a discharge of the mist collection device 50. The vapor or mist, designated by reference number 124, is drawn in through conduit 52 where the mist is then collected within the device 50 and formed into larger droplets of coolant which are then passed back into the system through conduit 122.

Figure 5:
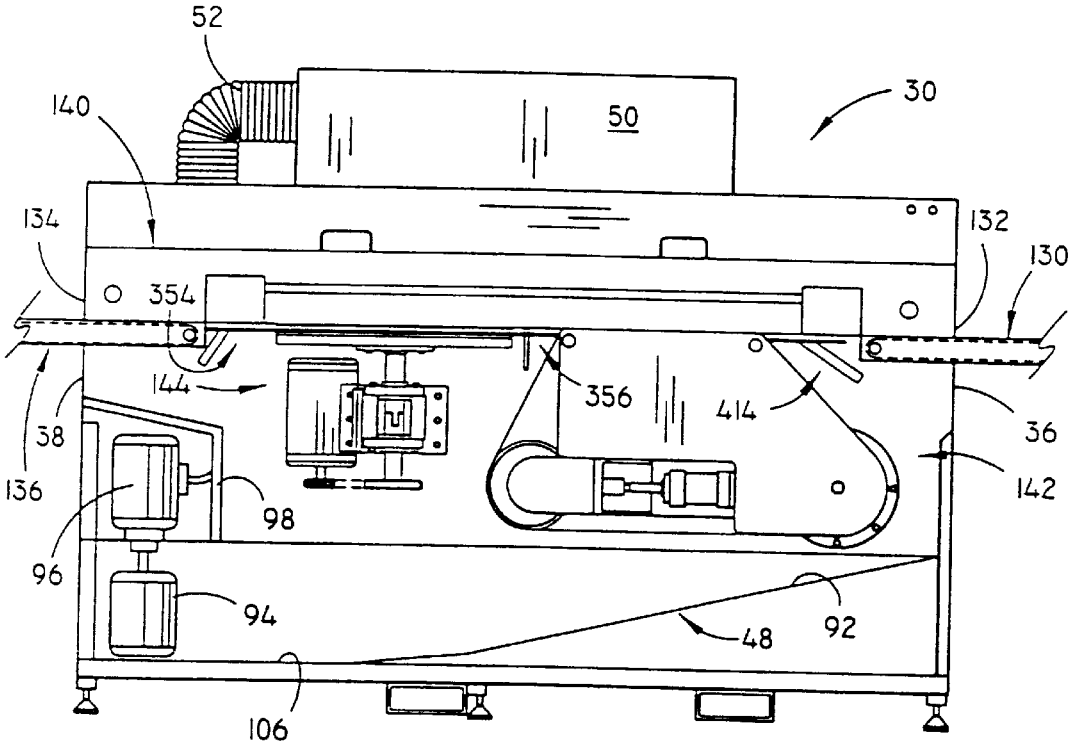
FIG. 5 is a front elevation view of the invention illustrating in general some of the components of the invention.

As briefly mentioned above, the back plate 90 forms the backbone of the frame assembly 70 from which a substantial number of the components comprising the automated deburring assembly 30 are supported. In general, and in addition to the tank 48, the basic components contained within the automatic deburring assembly 30 (FIG. 5) include an inlet conveyor assembly 130 which extends through an opening 132 in end wall 36 and is configured to transfer parts from a loading station to a first position inside the deburring machine 30. At the opposite end of the assembly 30 and extending through an opening 134 in end wall 38 is an exit conveyor assembly 136 for transferring parts from a second position inside the deburring assembly 30 to a collection bin (not shown). Extending substantially the length of the interior of the deburring assembly 30, and positioned above the interior ends of the inlet and exit conveyors 130, 136, is a pin rake conveyor assembly 140 which is intended to receive parts from the inlet conveyor assembly 130 and transport the parts from the first position to the second position, and through various processes. Positioned below and opposite the lower side of the pin rake conveyor assembly 140 and intermediate the inlet conveyor assembly and the exit conveyor assemblies 130, 136 is a first abrading assembly 142, such as a belt grinder, for abrading one surface or side of the workpiece in a first direction as it is translated by the pin rake conveyor assembly 140. A second abrading assembly 144 is located below and opposite the pin rake conveyor assembly and is positioned adjacent the first abrading assembly 142 at a location intermediate the inlet conveyor assembly 130 and the exit conveyor assembly 136. The second abrading assembly 144 is preferably in the form of a rotating disk which abrades one side of the workpiece in at least one direction different from that performed by the first assembly 142.

Pin Rake Conveyor Assembly

As briefly mentioned above, the pin rake conveyor assembly 140 is intended to convey a workpiece from a first position at the interior end of the inlet conveyor assembly 130 in a clockwise direction to a second point at the interior end of the exit conveyor 136. With reference to FIGS. 6–10, the pin rake conveyor assembly 140 includes a conveyor frame assembly 150 defined by front and back rails 152, 154 respectively, which extend substantially the length of the pin rake conveyor assembly 140. The ends of the rails 152, 154 are interconnected by left and right end members or stiles 156, 158, respectively. Attached to the inner wall 160 of each rail 152, 154, and positioned adjacent a lower edge 162, is a C-channel 164 (FIG. 8), wherein the channel is open toward the interior of the frame assembly 150. Each C-channel 164 includes an inverted L-shaped bracket 166, wherein a leg 168 of the bracket extends inwardly and is located along the upper edge of the bracket. A plate 170 is attached to a lower edge of the bracket 166 to define the opposite leg of the channel 172. The purpose of the C-channel 164 is to capture the edges of the conveyor as it moves in the clockwise direction as will become more apparent below.

Figure 6:
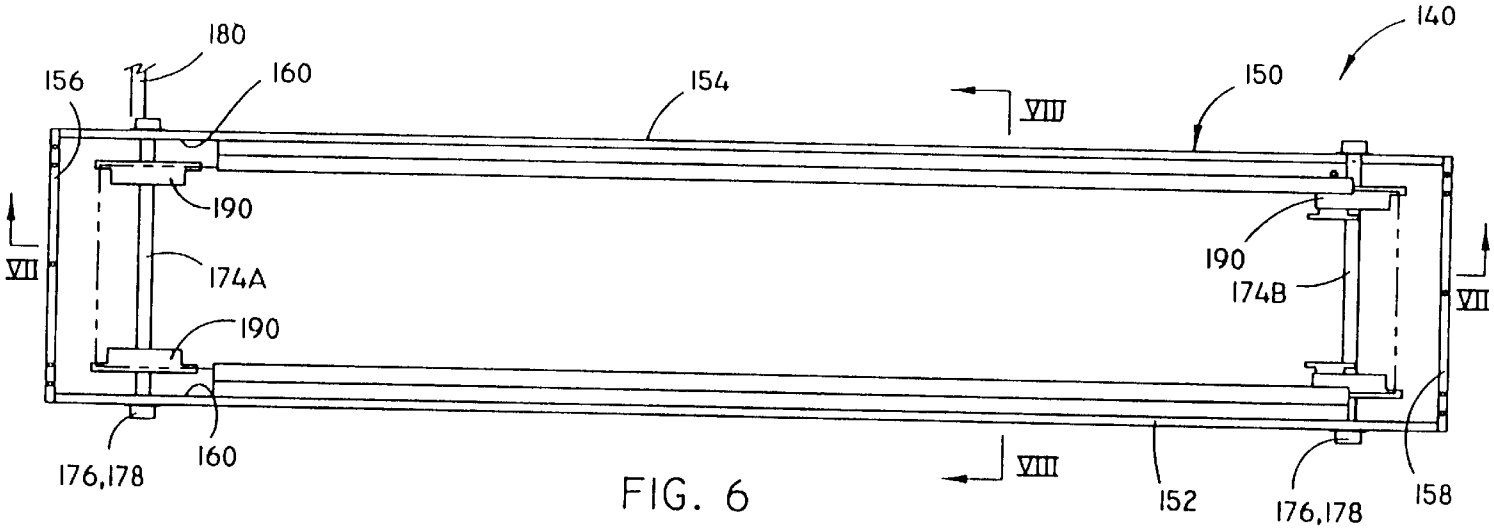
FIG. 6 is a plan view of a pin rake conveyor frame assembly.
Figure 7:
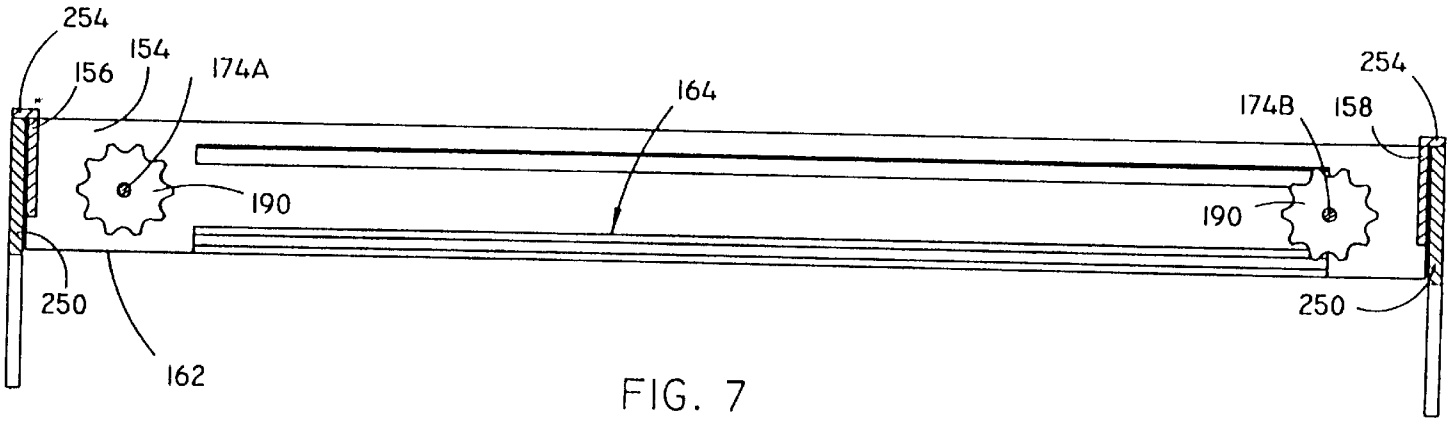
FIG. 7 is an elevation view of the pin rake conveyor frame assembly.

The frame assembly 150 captures between the rails 152 and 154 spindles 174A, 174B, the ends of which extend through the rails 152, 154. Each spindle 174A, 174B extends through bearings 176 mounted in the rails 152, 154, and the shafts are retained therein by keepers 178. The keepers 178 are urged against bearings 176 and are securely fastened to the ends of the shafts to prevent the shafts 174A, 174B from moving along the axis of the shafts. Shaft 174A shown in FIG. 6 is substantially longer than shaft 174B with an end 180 extending through an opening 182 in the back plate 90 (FIGS. 10 and 11) which is attached to a coupler 184. The coupler 184 interconnects the spindle 174A to a motor 186. Mounted on each spindle 174 (FIGS. 6 and 7) are sprockets 190 which are configured to engage the conveyor and cause it to rotate in the clockwise direction as will be described in greater detail below.

Figure 8:
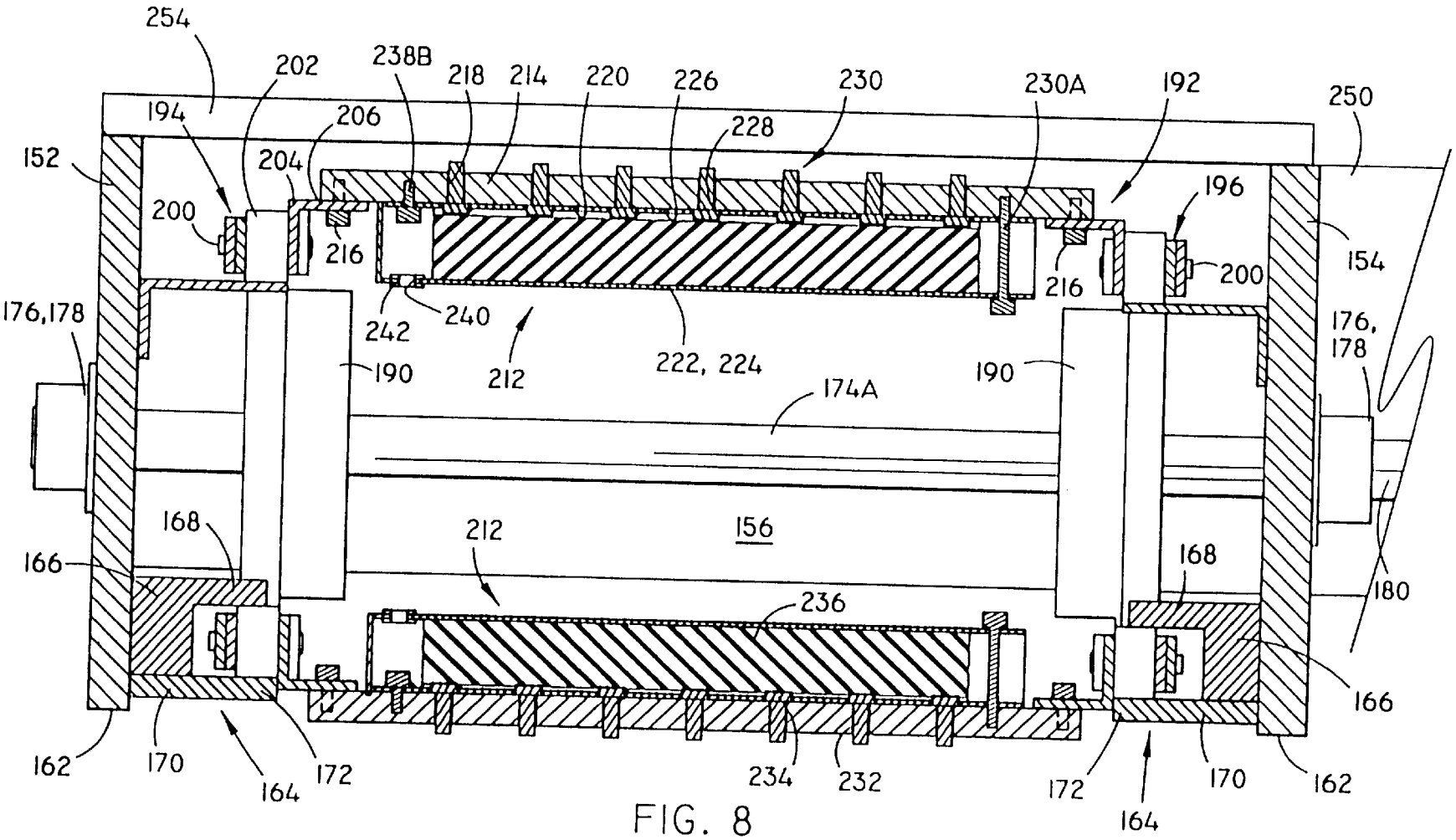
FIG. 8 is a fragmentary cross section view of the pin rake conveyor assembly shown in FIGS. 6 and 7.
Figure 9:
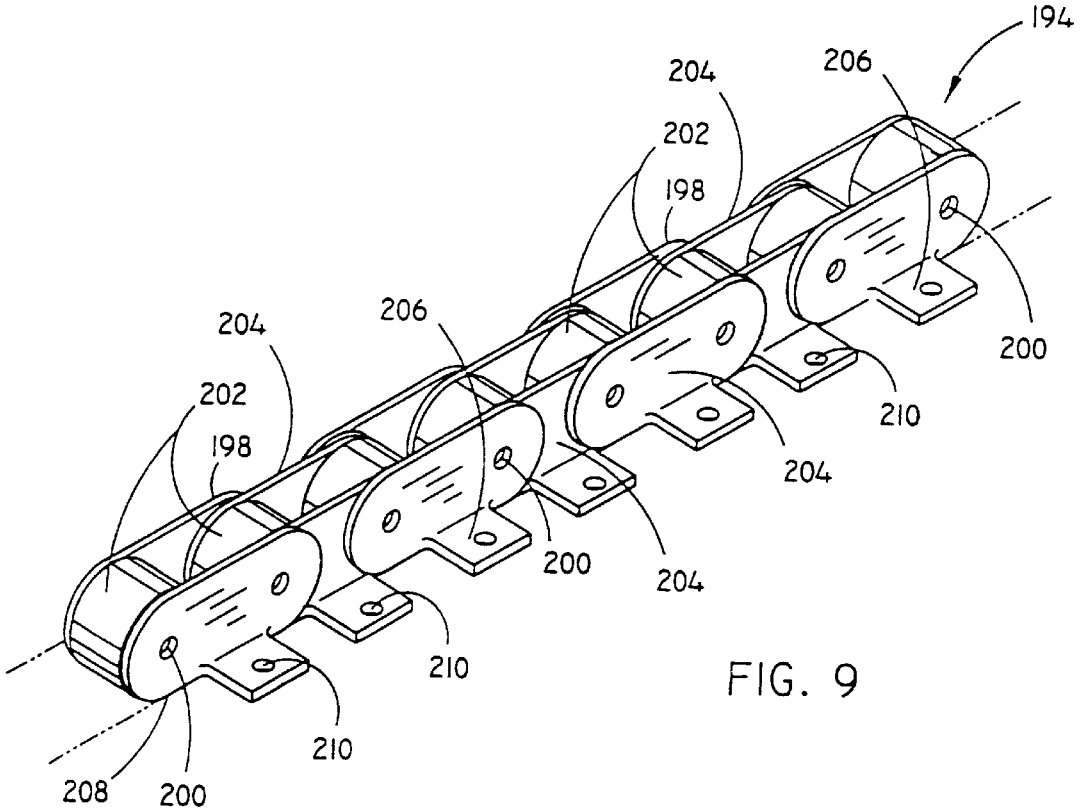
FIG. 9 is a fragmentary view of a section of one chain used in the pin rake conveyor assembly.

FIGS. 8 and 9 more clearly illustrate details of the pin rake conveyor mounted on the sprockets 190 and retained within the conveyor frame assembly 150. The pin rake conveyor 192 includes a front and rear continuous chain 194, 196, respectively, each extending substantially the length of the frame assembly 150 and around the sprockets 190. Each chain 194, 196 is formed from a plurality of links (FIG. 9), such as outer links 198 interconnected in overlapping relationship by pins 200. Each pin 200 also receives a bearing or wheel 202 which is then captured on the pins by overlapping inner links 204. Each inner link 204 includes a flange 206 which extends inwardly from a lower edge 208 toward the middle of the conveyor frame assembly 150. Each flange 206 is pierced by a hole 210, with the location of each hole on subsequent flanges being offset slightly in order to account for the staggering or overlapping relationship of adjacent links. The drawing figure illustrates a portion only of a single chain. The opposing chain is a mirror image of that shown in the drawing figure.

Interconnecting the flanges 206 on the opposing chain 194, 196 and extending therebetween is a pin rake assembly 212. Each pin rake assembly includes a pin retainer 214 attached at opposite ends by fasteners 216 to the flanges 206. The pin retainer 214 has a plurality of holes 218 extending therethrough. Attached to a back surface 220 of the pin retainer is a spring retainer 222 preferably formed from a rectangular or square length of tubing 224 wherein one wall 226 has a plurality of holes 228 extending therethrough which align with the holes 218 extending through the pin retainer 214. Disposed within the spring retainer 222 and extending through the holes 228 and through holes 218 are pins 230 having a shaft 232 and a head 234. Disposed within the tubing 224 and urging the pins 230 outwardly through holes 228 and 218 is a biasing member 234 such as a block of polymeric material such as neoprene or similar material. The spring retainer 222 is attached to the pin retainer 214 by fasteners 238 which extend through wall 226 and into the pin retainer 214. In a preferred embodiment, fastener 238A extends entirely through the spring retainer 222 while fastener 238B extends only through wall 226. An opening 240 provided in the top of the spring retainer 222 receives a polymeric grommet 242 for reasons which will become apparent below. The entire pin rake assembly 212 is attached to flanges 206 such that the pin retainer plate 214 is attached to the lower surfaces of the flanges 206 with the pins 230 projecting downwardly when the pin rake assembly is traversing along the lower portion of the continuous loop of the chain. With the pin rake conveyor mounted on the sprockets 190, the bearings/wheels 202 disposed between the inner and outer links 204, 198, respectively, engage the upper and lower flanges 168, 170 of the C-channel assembly 164 when the chain passes therethrough. In effect, the C-channel assembly controls the lowermost position of the pin rake conveyor assembly as it traverses along the lower loop within the frame assembly.

Figure 10:
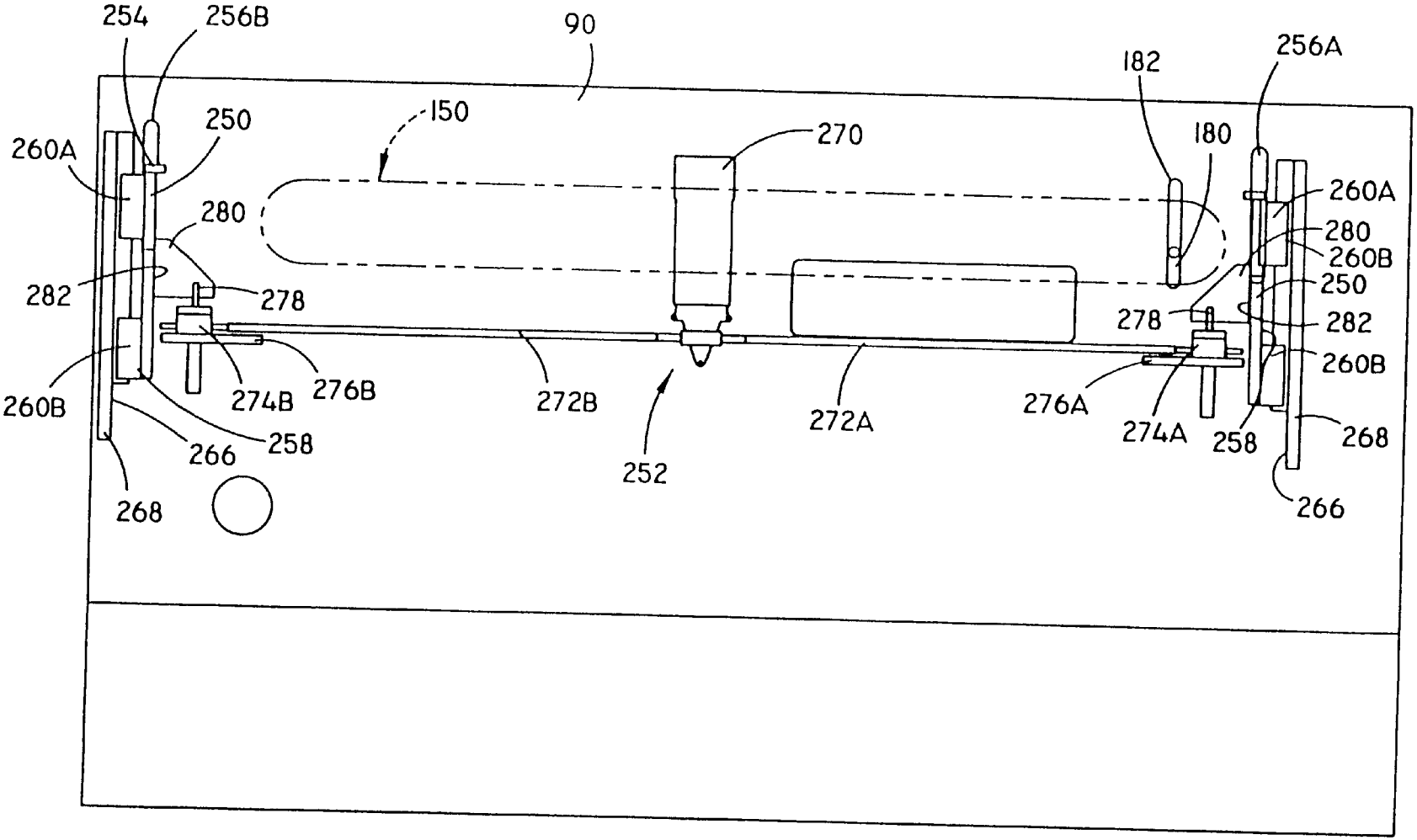
FIG. 10 is a rear elevation view of a height adjustment mechanism for the pin rake conveyor assembly.
Figure 11:
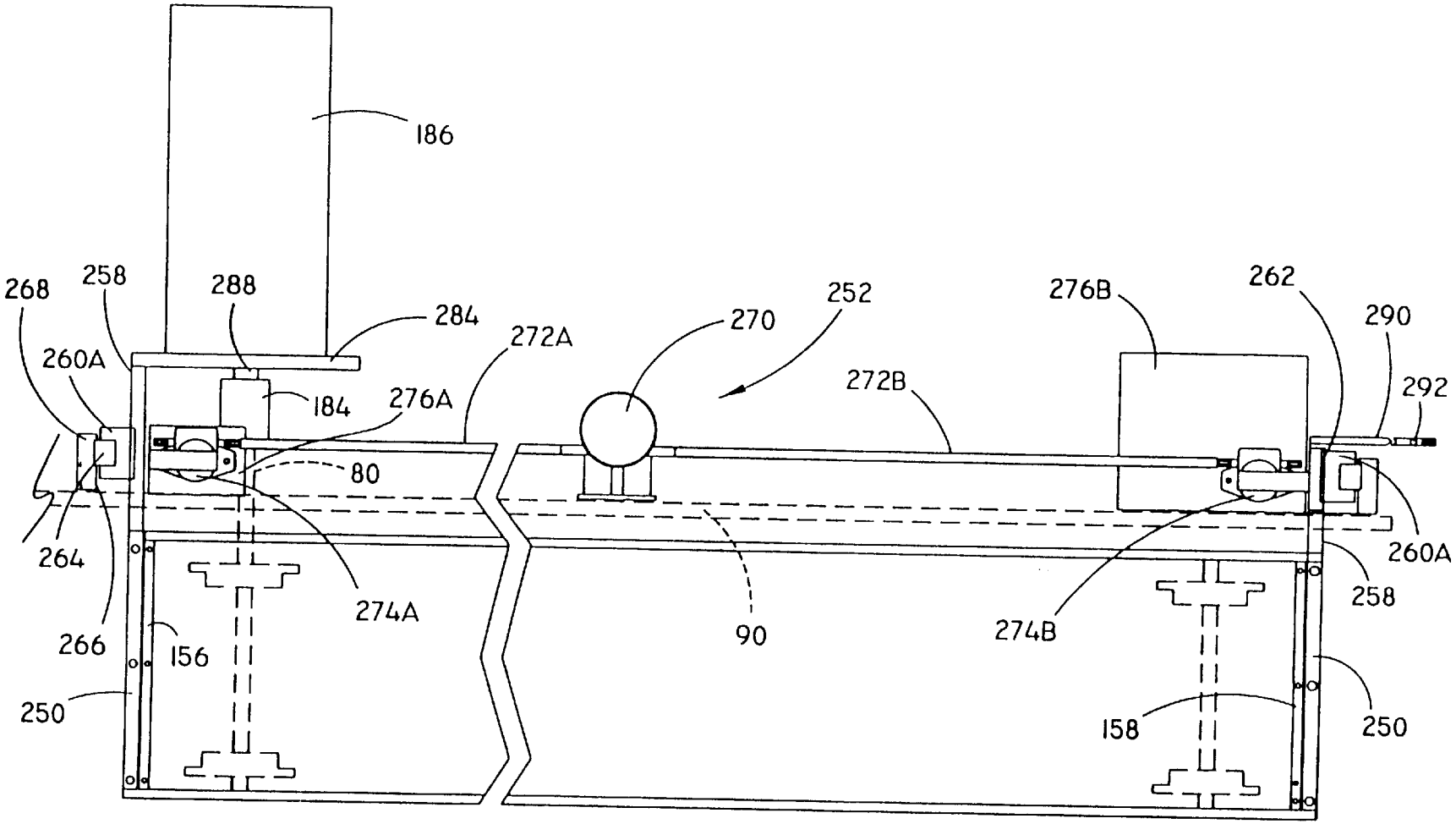
FIG. 11 is a plan view of the height adjustment mechanism shown in FIG. 10.
Figure 12:
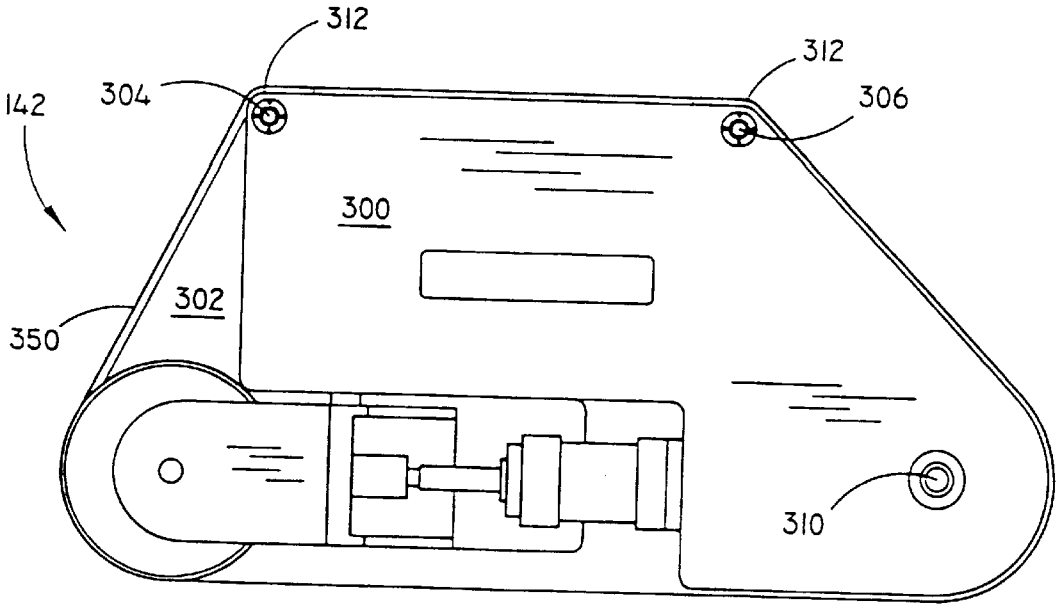
FIG. 12 is a front elevation view of a first abrading assembly.
Figure 13:
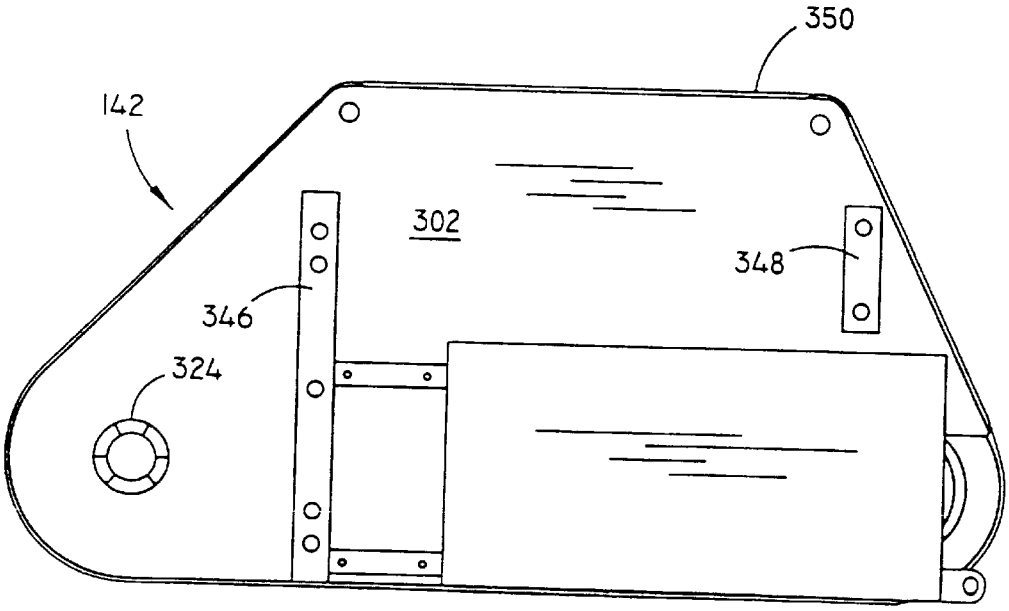
FIG. 13 is a rear elevation view of the first abrading assembly.
Figure 14:
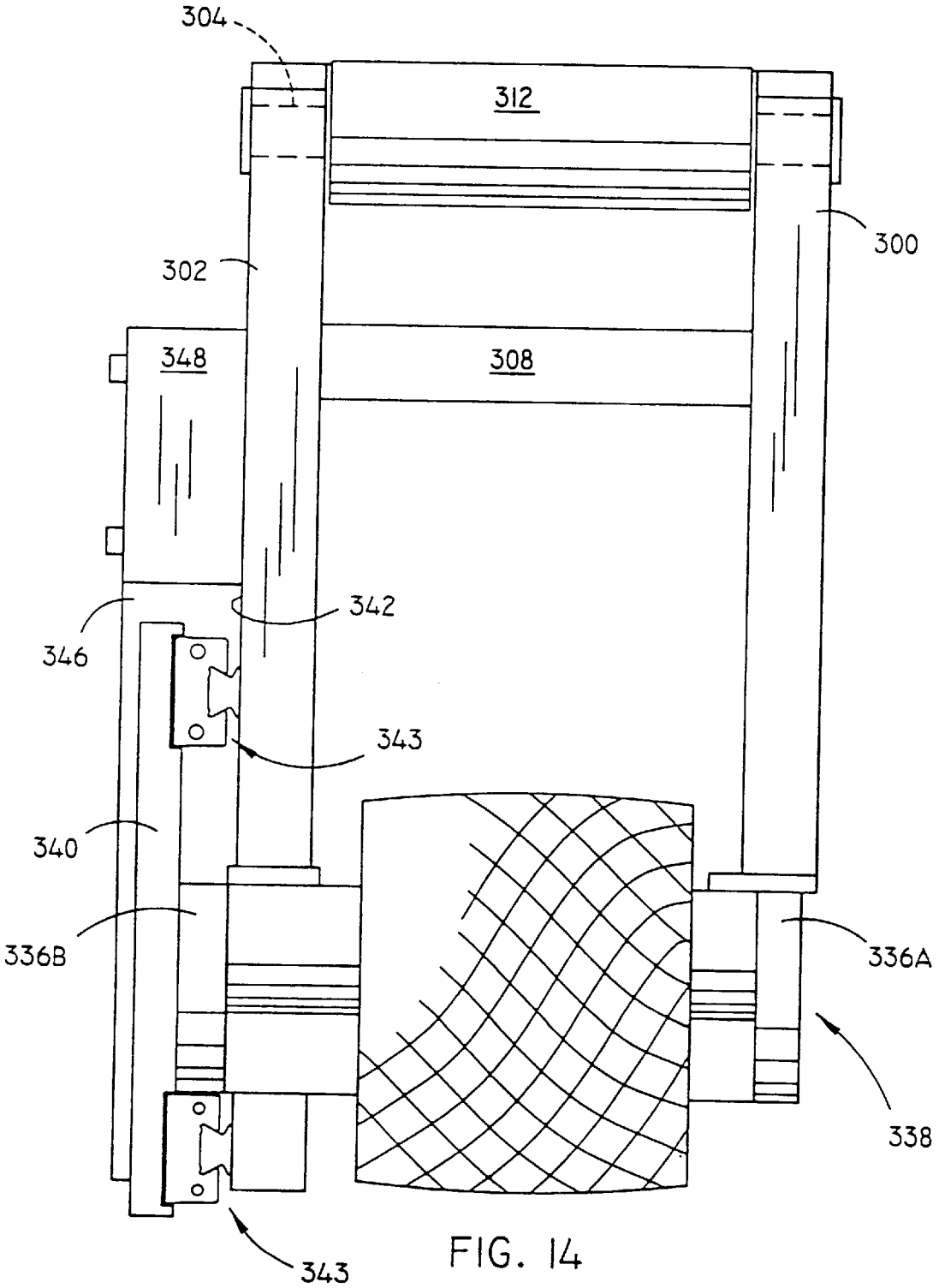
FIG. 14 is an end view of the first abrading assembly.
Figure 15:
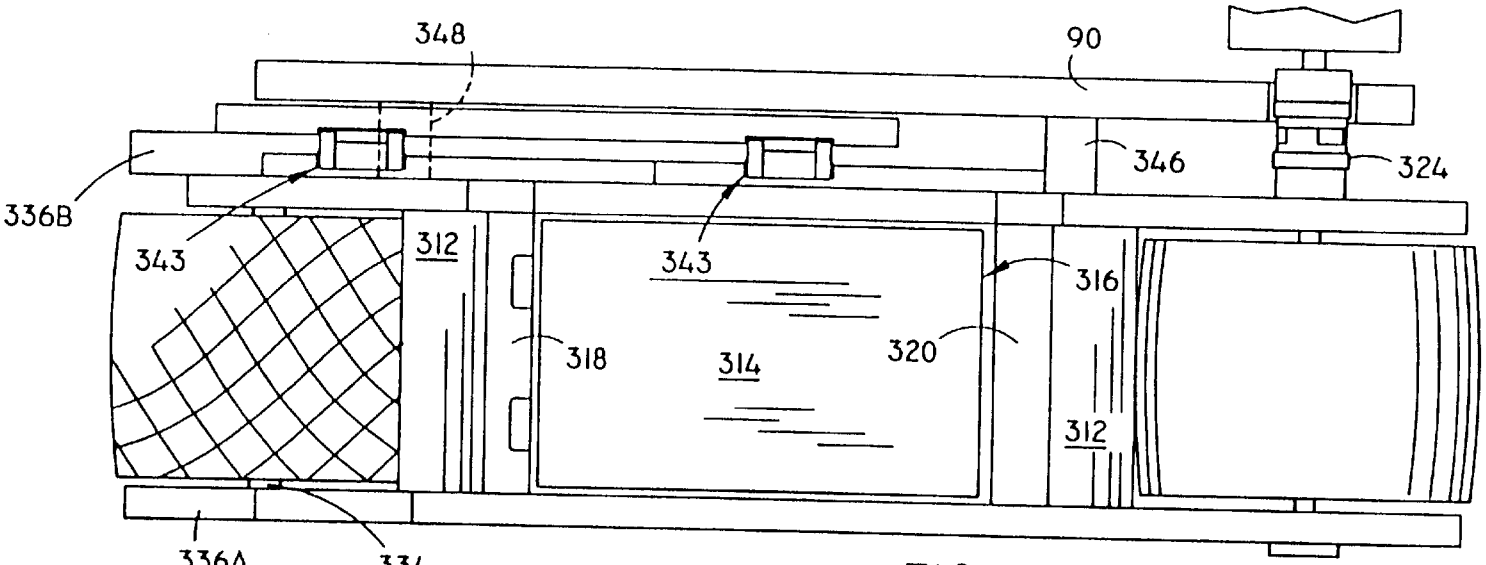
FIG. 15 is a plan view of the first abrading assembly.
Figure 16:
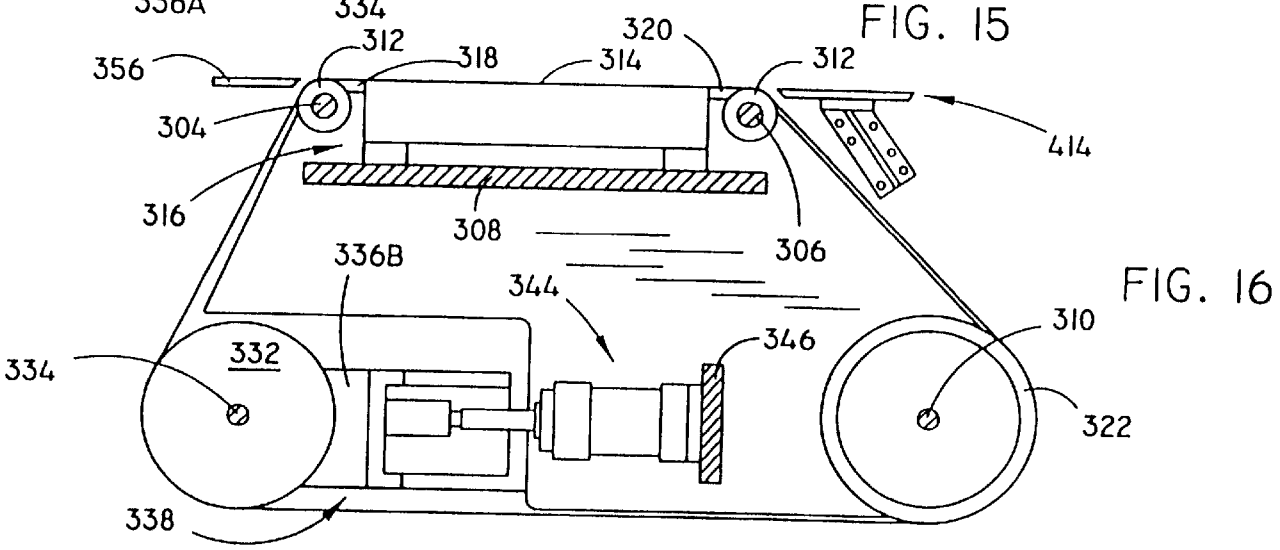
FIG. 16 is a fragmentary section view of the first abrading assembly taken along line XVI—XVI shown in FIG. 15.

It has been found to be advantageous to adjust the height of the pin rake conveyor assembly 140 with respect to the abrading assemblies 142 and 144 and the inlet and exit conveyors 130, 136, respectively. As shown in FIGS. 10 and 11, the stiles 156, 158 at the ends of the pin rake conveyor frame assembly 150 are interconnected to arms 250 of a height adjustment mechanism 252 by plates 254. The height of each arm is substantially equivalent to that of each stile and extends rearwardly from the conveyor frame assembly through openings 256A and 256B formed in the back plate 90. Once through back plate 90, the arms 250 extend downwardly such that when seen in profile, have an L-shaped configuration. As shown in FIG. 10, and attached to the outer sides 258 of each arm 250 are two, spaced apart, female portions of a linear bearing 260*a* and 260*b*. Each portion of the linear bearing is retained in a recess 262 formed in sides 258 to help rigidly fix the location of the blocks of the linear bearings on the arms. Additionally, it is preferred to space the female portion of the bearings from each other along the length of the arm to add rotational stability and account for the bending movements created by the weight of the pin rake conveyor assembly on the arms. The opposite or male portion 264 of the linear bearings is attached to a side 266 of a vertical member 268 which in turn is rigidly coupled to the back surface of the back plate 90.

Disposed between the rearwardly extending arms 250 from the back plate 90 is the actuating portion of the height adjustment mechanism 252. The height adjustment mechanism includes a centrally disposed drive unit 270 which is interconnected by opposing shafts 272A and 272B to vertical drive units 274A, 274B. Each of the vertical or right angle drive units 274A, 274B rest on a platform 276A and 276B cantilevered from the backside of the back plate 90. The extendable shaft 278 of each vertical drive unit 274A, 274B in turn is coupled to flange 280 which extends inwardly from an inner side 282 of the arms 250. Attached to the rear or back end of the left arm 250 is a motor mount or flange 284 which supports the motor 186 which has a shaft 288 extending through the motor mount 284 and is coupled or attached to end 80 of the spindle 174A via coupler 184. Upon the actuation of drive unit 270, shafts 272A and 272B rotate in the same direction to actuate the right angle drives 274A and 274B. The shaft 278 vertically disposed within each drive 274A, 274B translates up or down in response to the input from shafts 272A, 272B. The vertical translation of the shafts, coupled through flanges 280 connected to the arms at the opposite ends of the pin rake conveyor translate the conveyor vertically with respect to the back plate and the upper surfaces of the abrading assemblies 142 and 144 and the inlet and exit conveyor assemblies 130 and 136.

Extending from the back of the right rear arm 250 (FIG. 11) and extending to the right is a height adjustment probe 290. The probe is positioned at a point generally commensurate with the lowermost point of the pin rake conveyor and is disposed above a horizontal surface substantially even with the upper surface of the inlet conveyor assembly 130. The tip of the probe has a sensor 292 mounted thereon which is sensitive to forces perpendicular to the horizontal surface. The probe 290 and sensor 292 are used to measure the height of a workpiece above the horizontal surface to set the height of the pin rake conveyor with respect to the upper surface of the inlet conveyor and the abrading devices to permit passage of the workpiece by the conveyor system described above. The objective is to set the height of the pin rake conveyor such that the resilient pins 230 engage the workpiece, and not the pin retainer 214. The probe and sensor, 290, 292, respectively, are coupled and controlled by an integrated circuit and programmable logic controller disposed within the control cabinet 66.

Belt Grinder Assembly

The first abrading or grinder assembly 142 briefly mentioned above with respect to FIG. 5 is more clearly illustrated in FIGS. 12–16. With reference to those figures, the first abrading assembly, also known as belt grinding assembly, abrades the lower surface of a workpiece translated by the pin rake conveyor assembly using a continuous loop or belt 350 having an abrasive surface. The belt grinder assembly 142 includes a front and rear substantially parallel and spaced apart frame members 300, 302, respectively (FIG. 14), interconnected along an upper edge at two spaced apart locations by left and right axles 304, 306 respectively, an intermediate horizontally disposed cross-member 308, and in a lower or right-hand corner by drive shaft 310. Each of the left and right axles 304,306 retain a idler roller 312 thereon having a radius such that the outer surface of the roller extends slightly beyond the perimeters of the frame members 300, 302 such that a horizontal line tangential to the idler rollers 312 is slightly above and parallel to the upper planar surface 314 (FIGS. 15 and 16) of an electromagnet 316 disposed on cross-member 308 and between the idler rollers 312. Each of the idler rollers have internal roller bearings to provide a substantially friction-free interaction with the shafts 304, 306. Plates 318 and 320 are located between the electromagnet 316 and each of the idler rollers 312 so very little gap exists between the uppermost point of the idler rollers 312 and the edges of the electromagnetic plate upper surface 314. Plates 318 and 320 are preferably made from bronze or aluminum but may also be formed from other metals such as steel.

The drive shaft 310 extending between the front and rear frame member in the lower right-hand portion of the grinder supports a drive roller 322 having a radius sufficient to place the surface of the drive roller slightly beyond the profile of the frame members. The shaft is retained by bearings (not shown) to provide easy rotation. The back end of the shaft extends through the rear frame member and terminates in a polarized coupler 324 which interconnects the shaft with a drive motor (not shown) mounted to the back surface of the back plate 90. It is preferred that the bearings, coupler, and motor be selected to operate efficiently at approximately 16,000 revolutions per minute. The tracking roll 332 is provided at a lower left-hand portion of the belt grinder 142 and includes a crowned drum configured to place a grinding belt in tension and hold the belt in the correct position. The tracking drum 332 is mounted on a shaft 334 held between legs 336A, 336B of a yoke 338. Leg 336B of the yoke is rigidly secured to a plate 340 mounted in sliding relationship to the rear surface 342 of the back frame member 302. In a preferred embodiment, plate 340 is attached by four linear bearings 343 secured to the back surface of the frame member 302 to ensure that the tracking drum slides along a single axis with respect to the remainder of the grinder. Actuation of the tracking roll 332 between an extended and retracted position is achieved by a linear actuator 344 having one end secured to a block 346 mounted between the frame members 300, 302 and the opposite end secured to the back of the yoke 338. The first abrading assembly, or a continuous belt grinder 142, is cantilevered from the front surface of the back plate 90. A first vertical plate 346 (FIG. 13) attached to the rear surface of frame member 302 to the left of and slightly below left axle 304, and a second vertical plate 348, also extending from the rear surface of frame member 302, below and slightly to the right of right axle 306, both contain pins to be received in holes defined in the backing plate 90 and are originally fixed thereto by bolts which extend through the back surface of the backing plate 90 and into each of the vertical plates. Both of the plates 346, 348 also serve to space the assembly 142 from the backing plate to permit translation of plate 340 mounted to the tracking roll 332 and yoke 338. The continuous belt grinder 142 is configured to receive the sanding belt 350 having an outer surface containing an abrasive medium. The sanding belt is retained on the grinder by extending the tracking roll and through the shape of the tracking roll which centers the belt and maintains that position as it cycles about the grinder. The electromagnet 316 located at the top of the grinder is intended to create an electromagnetic force and draw magnetic components toward the surface 314 while the grinding belt is rotating in order to ensure that the components fully engage the grinding surface. The bronze plates 318 and 320 adjacent the electromagnet are not attracted to the surface as the material is nonmagnetic and does not bind or remain fixed on the electromagnet while in operation.

Disk Grinder Assembly

Figure 17:
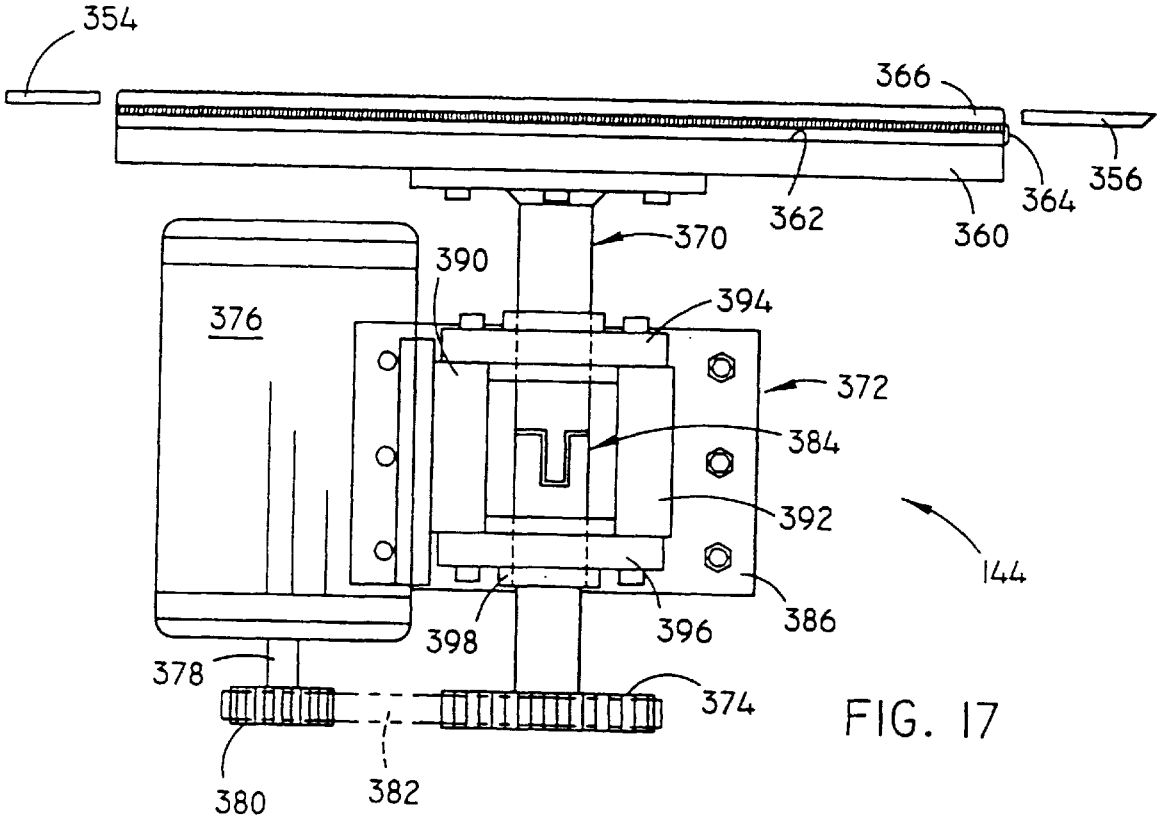
FIG. 17 is a front elevation view of a second abrading assembly.
Figure 18:
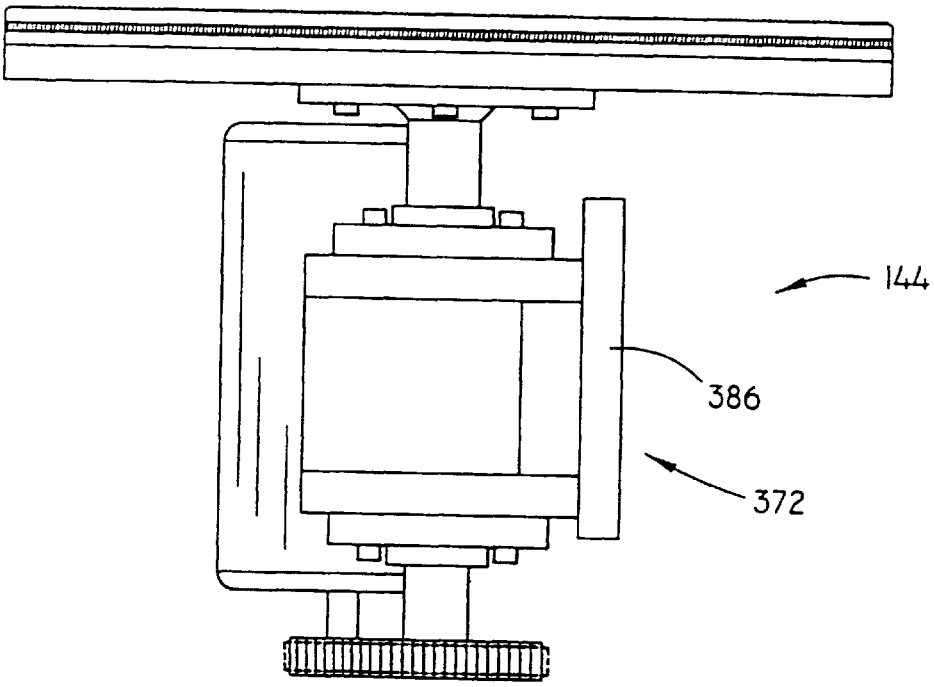
FIG. 18 is a side elevation view of the second abrading assembly.
Figure 19:
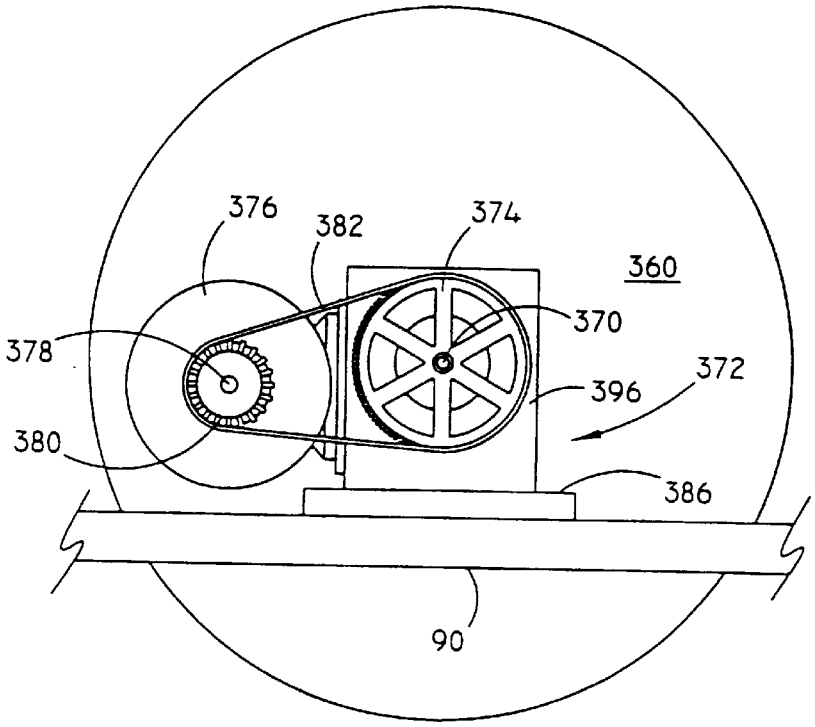
FIG. 19 is a bottom plan view of the second abrading assembly.

The second abrading assembly 144, also known as a disk grinder (FIGS. 17, 18 and 19), is located opposite pin rake conveyor assembly 140, and intermediate the inlet conveyor assembly 130 and the exit conveyor assembly 136 and is provided to work on the surface of the parts or components in directions different from that provided by the first abrading assembly 142. (See FIG. 5.) The disk grinder 144 includes a platen 360 which, in the preferred embodiment, is circular in form and includes an upper surface 362 covered with one half of a hook-and-loop fastener 364 which is adapted to engage an opposite half fixed to the lower surface of an abrasive disk 366. The hook-and-loop fastener 364 rigidly secures and locates the abrasive disk 366 on the platen for the abrading process. The lower surface 368 of the platen is concentrically attached to a shaft 370 which extends through a journal plate attached to mount 372 secured to the back plate 90 and support the platen 360 in position. A lower end of the shaft 370 terminates in a pulley 374. Adjacent the mount 372, and dependent therefrom, is a disk drive motor 376 having a downwardly depending shaft 378 terminating in a drive pulley 380. A belt 382 interconnects the drive pulley 380 to the shaft pulley 374 for spinning the platen 360 in the desired direction. In a preferred embodiment shaft 370 preferably includes an upper portion 370A and a lower portion 370B interconnected by an intermediate finger coupler 384 to permit vertical adjustment of the upper shaft 370A depending from the platen 360 if necessary. Additionally, the lower portion 370B may be quickly disconnected from the upper portion of the shaft to accommodate different-sized pulleys and a change in the revolution rate of the platen 360. The mount 372 preferably includes a base plate 386 from which extend two vertically arranged and spaced apart left and right arms 390, 392 respectively, which support an upper journal plate 394 and a lower journal plate 396, both having bearings 398 extending about and receiving the shaft 370. The upper and lower journal plates 394, 396, respectively, are preferably bolted to the left and right arms 390, 392 to secure the plates in position.

The diameter of the platen 360 may vary, but in a preferred embodiment, the diameter of the platter is sufficient to extend from a point proximate the exit conveyor to a point proximate the left axle or idler roller 312, yet remain substantially within the confines of the main cabinet 332. A rectangular opening 358 (FIGS. 3 and 10) may be provided in the backing plate 90 to accommodate a portion of the platen's width. In addition, platen 360 may be mounted with a resilient pad between the hook-and-loop fastener and the platen so that the abrasive disk can partially conform to narrow areas of the workpieces to improve the ability to remove burr remnants (from belt grind process) from inside holes. Adjacent the periphery of the platen 360 (FIG. 17) are relatively small tables or platforms 354 and 356 intended to occupy the gap between the periphery of the platen and the exit conveyor on the left-hand side and the idler roller 312 on the right-hand side. Absent these platforms, the workpieces may fall from the conveyor and not be transported to the succeeding station.

Figure 20:
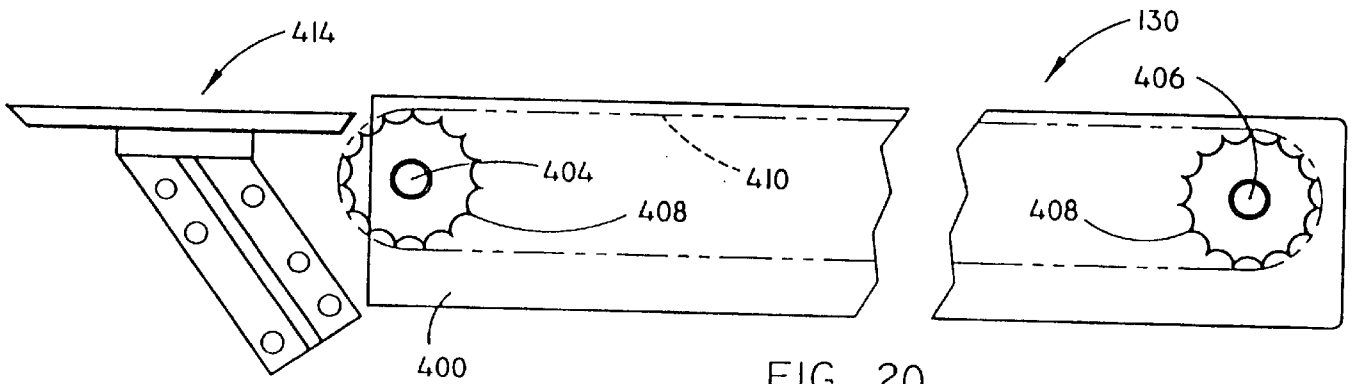
FIG. 20 is an elevation view of an inlet conveyor assembly.
Figure 21:
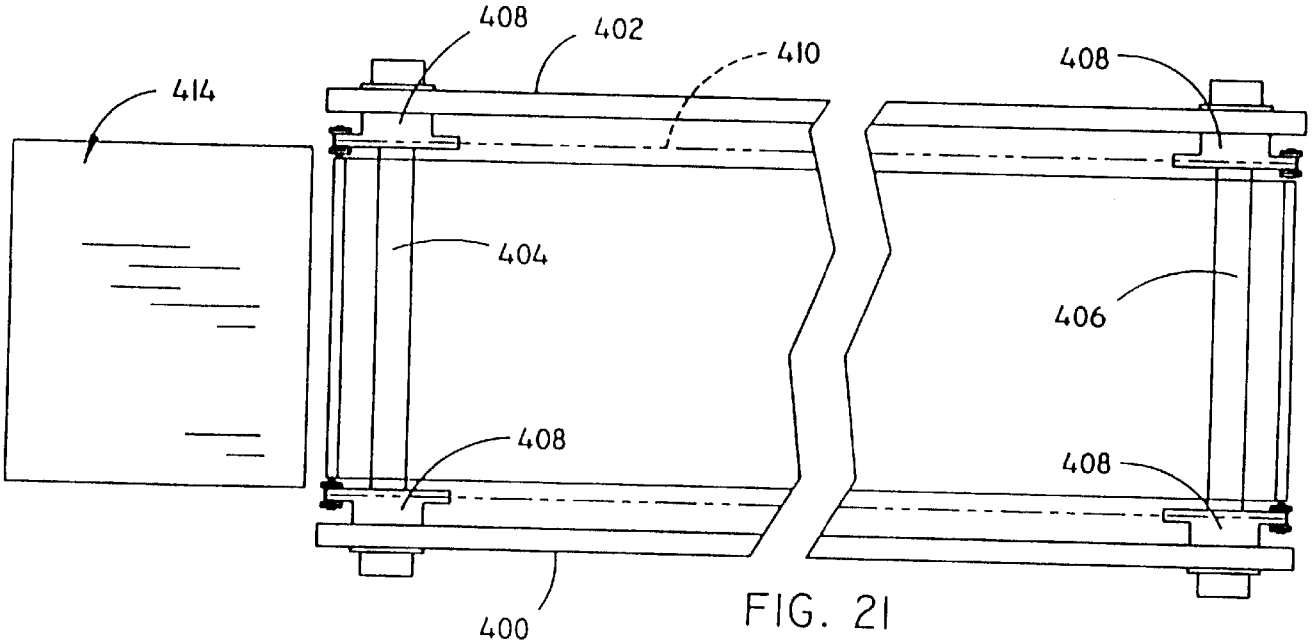
FIG. 21 is a plan view of the inlet conveyor shown in FIG. 20.
Figure 22:
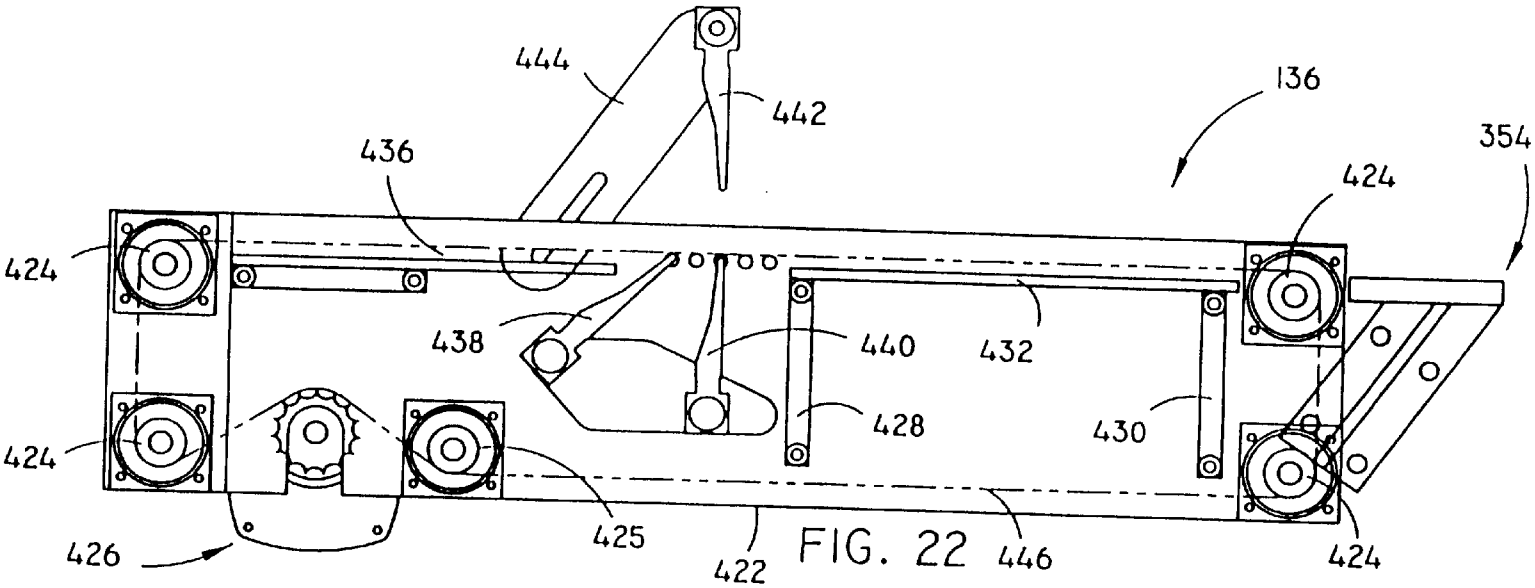
FIG. 22 is an elevation view of an exit conveyor assembly.
Figure 23:
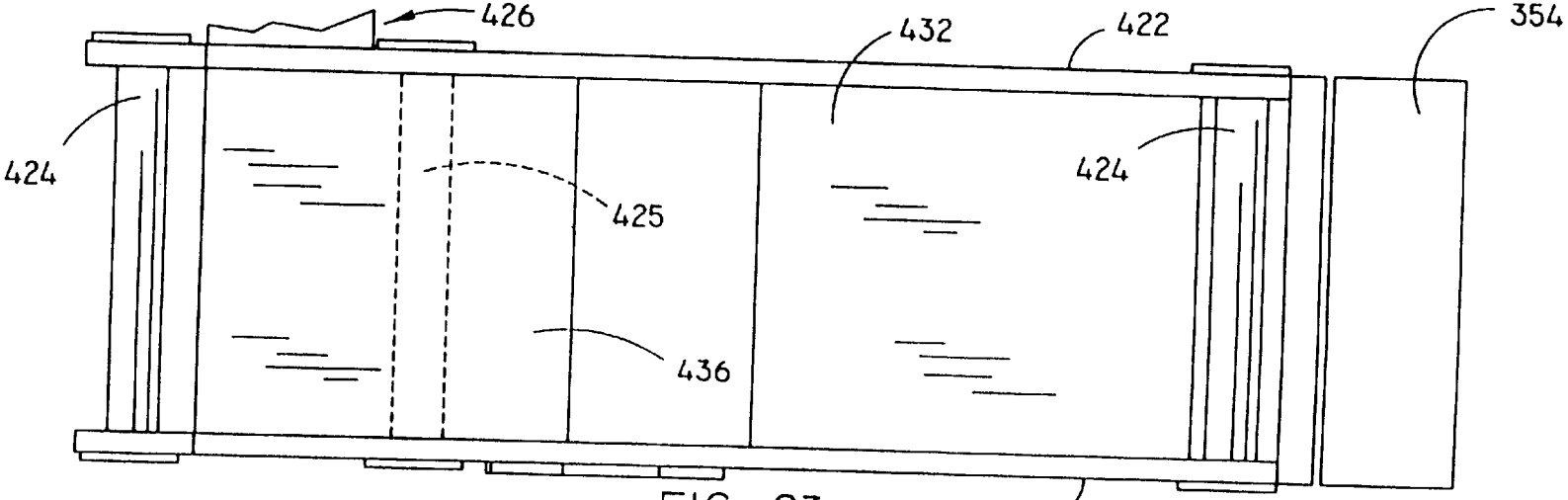
FIG. 23 is a plan view of the exit conveyor assembly shown in FIG. 22.

Conveying workpieces in and out of the deburring assembly 30 are the inlet and exit conveyor assemblies, 130, 136, briefly mentioned above. Inlet conveyor assembly 130 (FIG. 20) includes opposing and parallel inlet conveyor frame members 400, 402, interconnected by left and right spindles 404, 406, respectively having toothed rollers 408 disposed thereon. The conveyor chain 410 is preferably formed from a plurality of chain links interconnected together to form a continuous loop conveyor mat wrapped around the toothed rollers 408. Spindle 404 at the left end of the inlet conveyor is interconnected to a drive unit mounted to the back surface of the back plate 90. The gear ratio of the drive motor 412 connected to the spindle is such that the movement of the conveyor chain 410 is the same speed as the pin rake conveyor assembly. In a preferred embodiment, it has also been found advantageous to have a table top or work area at the end of the inlet conveyor or adjacent one side of the conveyor such that the operator may sort the workpieces and place them in the desired orientation on the inlet conveyor for feeding to the pin rake conveyor.

The exit conveyor assembly 136 located at the opposite end of the deburring assembly 30 includes a first and second horizontally disposed and substantially parallel exit conveyor frame members 420, 422 which support four horizontally disposed and parallel rollers 424, each one positioned and mounted at the corners of the respective plates 420, 422. Attached to the back plate 422, and attached proximate a lower edge is a drive assembly 426 wherein the motor housing is attached to the exterior of the back plate 422 with the shaft and gear disposed toward the interior of the frame members 420, 422. To the right and adjacent the drive assembly 426 is a fifth roller 425 similar to those disposed at the corners. Also disposed between and interconnecting plates 420, 422 are two vertically arranged plates 428 and 430 which are interconnected along their upper margin by horizontal plate 432. In the upper left-hand corner of the assembly and also interconnecting the plates 420, 422 are two substantially horizontal bars or strips between which support a horizontal plate 436. Between the right edge of horizontal plate 436 and the left edge of horizontal plate 432 in the interior of the exit conveyor assembly are two air knives 438, 440 of which knife 438 is angled upward and to the right while air knife 440 is angled substantially vertical. A similar air knife 442 is mounted above the exit conveyor assembly 136 and supported by brackets 444 to orient the air knife downwardly at a position substantially above the air knife 440. Extending around the rollers 424 and upwardly over the drive socket of the drive assembly 426 is a continuous loop chain mesh 446 which is driven by assembly 426 to rotate in a counter-rotating direction. The horizontally disposed plates 432 and 436 support the upper length of chain as it moves around about the rollers. The conveyor chain mesh permits the lubricating coolant to drip from the parts or components as they pass from the pin rake conveyor which is blown from the parts as they pass between the air knives.

Operation

With the automatic deburring assembly 30 assembled as shown in the drawing figures, and with tank 48 and tank 112 of the filter assembly 60 substantially filled with lubricating coolant, the operator selects the height of the pin rake conveyor by measuring the height of the workpiece with the probe 292. With the height of the pin rake conveyor assembly appropriately set using the probe 290 and the sensor 292, the operator locates the workpiece on the inlet conveyor where it is transported by chain 410 toward the first position at the right end of the pin rake conveyor. Because it is intended that the speed of the chain conveyor 410 matches that of the pin rake conveyor 140, the workpiece is engaged by the pins 230 extending from the pin rakes 212 and moved by the conveyor toward the abrasive belt 350. The neoprene biasing member 236 disposed within the spring retainer 222 permits adjustment of the pins as they engage the workpiece permitting the pins to retract slightly. Pins which extend over the edge of the workpiece do not retract and provide a lip for moving the workpiece forward.

As the workpiece is conveyed over the continuous belt grinder 142, the electromagnet 316 attracts the workpiece toward the surface 314 to ensure that the abrasive belt 350 positively engages the lower surface of the workpiece. As the workpiece passes over the abrasive belt, the workpiece is deburred in a direction generally parallel to the direction of travel of the workpiece over the belt. Following the continuous belt grinder, the workpiece is passed over platform 356 onto the right hand portion of the rotating abrasive disk 366. The angular rotation of the disk 366 abrades the lower surface of the workpiece in a direction different from that achieved by the continuous belt grinder 142 and the direction continues to change as the workpiece moves along the upper surface of the disk 366 until the direction is opposite on the left-hand portion of the disk than it was on the right-hand portion. Again the pins 230 depending from the pin rake 212 hold the workpiece in place as it is subjected to the variety of horizontal forces produced by the abrasive pads or belts. Following the deburring by the disk grinder 144, the workpiece is passed over plate 354 onto the exit conveyor assembly 136 where it is transported by chain 446 out through the end 38 of the assembly 30.

Throughout the grinding process, the workpieces deburred by the assembly are exposed to the lubricating coolant which helps remove the cuttings or swarf from the components as they are abraded and to cool and lubricate the components throughout the entire process. In addition, the lubricating coolant cools the grinding components as well. As a result, when the part being worked on reaches the exit conveyor, it is typically dripping in the lubricating coolant. The air knives 438, 440, and 442 direct forced air against the components and remove as much of the lubricating coolant as possible before the component is discharged to a bin. The lubricating coolant removed by the moving currents of air gather and drip back into the storage tank 48 located at the bottom of the assembly 30. Substantially all of the fluid which is in particles large enough to form drops are collected in tank 48 along with the swarf. The pump 104 located in the sump 106 takes the contaminated lubricating coolant in the tank 48 and passes it over a magnetic roller and through a porous filter media where substantially all of the swarf is removed from the fluid which is collected in a tank at the bottom of the filter assembly. A second set of pumps located at the bottom of the filter tank assembly take the filtered fluid and reintroduce it at the top of the deburring assembly 30 at strategic locations to provide the cooling and lubricating action during the grinding process. Particles of the lubricating coolant which are substantially small enough to be carried by air currents within the deburring assembly 30 are drawn under a negative vacuum up through the top of the cabinet 32 into a conduit 52 which interconnects the cabinet interior to a mist collection device 50 located at the top of the cabinet. The mist collection device collects the mist particles and condenses them into larger particles sufficiently large enough to move as a volume back into the lubricating cooling system at the top of the main cabinet 32. The negative pressure created by the vacuum of the mist collection system also draws ambient air into the inlet and outlet openings provided for at the ends of the cabinet for the inlet and exit conveyor assemblies. Ambient air is also drawn in through openings in the back plate through which the drive spindle and the pin rake conveyor height adjustment arms extend into the cabinet. This process substantially reduces the amount of vapors which escape into the ambient air typically associated with the grinding process.

The method and apparatus of this invention substantially improves the efficiency of the deburring process over the entire surface of the workpiece than previously achieved. The positive engagement by the pin rake conveyor urges the workpiece against the abrading surfaces of the belt and disk so that the desired surface of the workpiece is exposed to the abrasive action. In addition, instead of the abrasive working in a single direction as in the prior devices, the workpiece is abraded in multiple directions so that burrs and sharp edges are acted upon by the abrasive in all directions. The positive engagement by the conveying system also securely locates the workpiece with respect to the abrasives to prevent the workpiece from slipping or moving under the forces upon it by the abrasive belts or disks. The secure location of the workpiece during the deburring process also substantially improves the output of the deburring assembly. Because the workpieces are securely fixed, a greater number of workpieces may be passed through the machine, resulting in increased productivity. Increased productivity of the deburring assembly, in combination with the multidirectional deburring processes, results in substantially reduced cost and uniform quality output than previously achieved.

Figure 25:
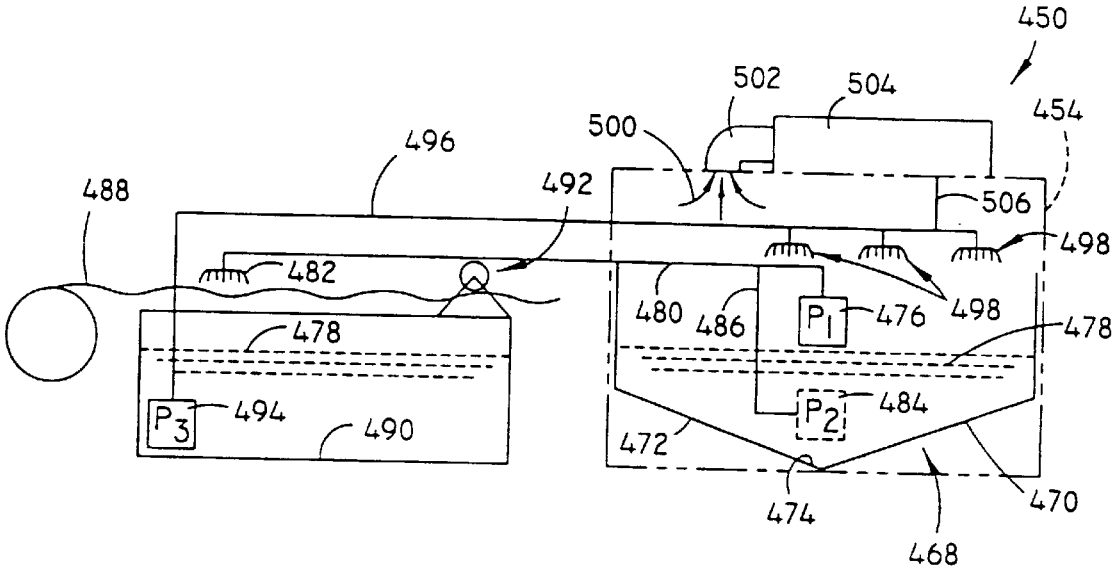
FIG. 25 is a schematic of an alternate embodiment of the circulating system.
Figure 24:
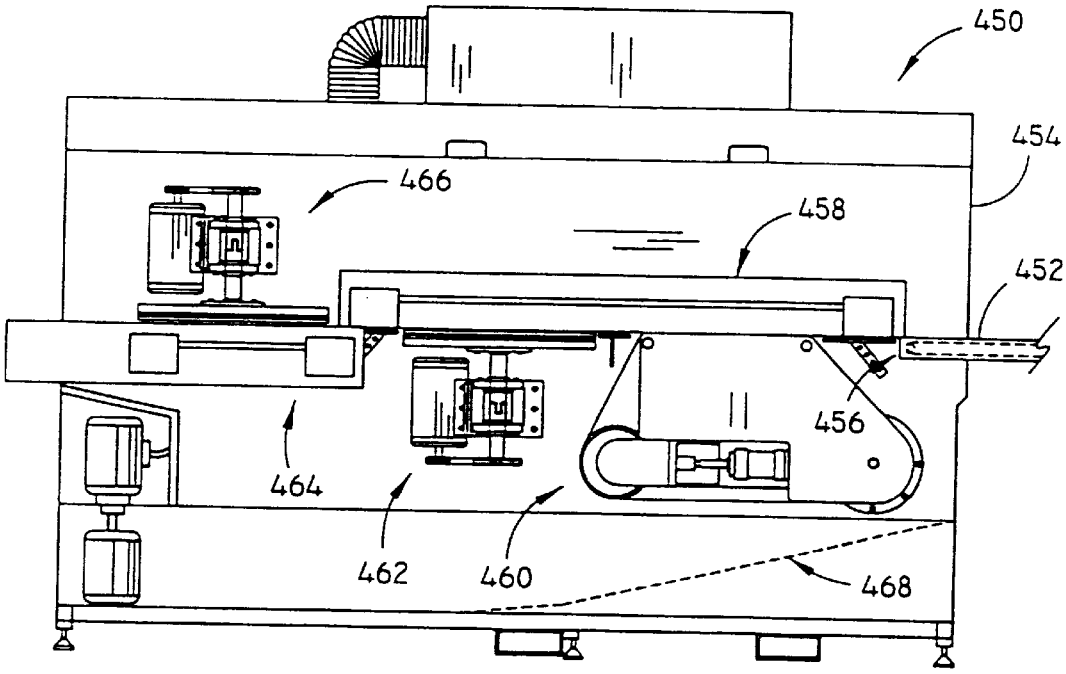
FIG. 24 is a front elevation view of an alternate embodiment of the invention.

FIGS. 24 and 25 illustrate an alternate embodiment of the invention wherein both sides of the workpiece may be deburred. As in the previous embodiment, the alternate embodiment of the invention 450 includes an inlet conveyor assembly 452 for transporting workpieces from a loading position outside of the cabinet 454 to a second position interior the cabinet. The second position, at a point proximate the interior end 456 of the inlet conveyor assembly 450, the workpiece is engaged by a pin rake conveyor assembly 458 similar to that described above. The pin rake conveyor 458 transports the workpiece from the first position proximate the end of the inlet conveyor assembly over the first abrading assembly 460 abrading a first surface of the workpiece in a first direction, and a second abrading assembly 462, abrading the same work surface of the workpiece in directions different from that produced by the first abrading assembly. From the second abrading assembly, the pin rake conveyor assembly 458 transports the workpiece to a second pin rake conveyor assembly 464. The second pin rake conveyor assembly transports the workpiece from the discharge end of the first pin rake conveyor assembly 458 past a third abrading assembly 466 which deburrs the opposite surface of the workpiece. Although a disk-type abrading device is shown as the third abrading assembly 466, it is contemplated and understood that the belt-type assembly such as 460 may be used in place of the disk-type assembly. The second pin rake conveyor assembly, operating in a counterclockwise direction, moves the workpiece past the third abrading assembly to a discharge position exterior the cabinet 454.

As in the previous embodiments, the alternate embodiment uses a lubricating coolant which is contained within a tank 468 located at the bottom of the assembly 450. As shown in FIG. 25, tank 468 may have two downwardly sloping walls 470, 472 to define a central valley region 474 which acts as a sump. A first pump 476 may be located proximate the surface of the lubricating coolant 478 for the purposes of pumping coolant containing floating swarf or other debris through a conduit 480 to a discharge 482. A second pump 484 may be located in the sump for pumping lubricating coolant laden with submerged swarf through a conduit 486 to the discharge nozzle 482. The lubricating coolant falling from the discharge 482 passes through a filter media 488 and into tank 490. A magnetic drum assembly 492 removes the coarse swarf from the filter media 488 for later disposal along with the filter media 488. The lubricating coolant 478 within tank 490 is pumped by pump 494 through conduit 496 through a plurality of nozzles 498 strategically located within the assembly 450 where it serves to lubricate the workpieces during the abrading process and cool the devices doing the abrading. The lubricating coolant then flows downwardly back toward tank 468. Additionally, mist of the lubricating coolant generally referenced as the arrows identified by the numeral 500 are drawn through an aperture in the top of the cabinet and into a conduit 502 where it is recollected and gathered in a mist collection device 504. The mist or lubricating coolant droplets are condensed and reintroduced into the interior of cabinet 454 through conduit 506 coupled to conduit 496 and the nozzles 498.

It is contemplated that the respective positions of the different abrading assemblies may be alternated or reconfigured such that the workpieces may be abraded in a different order than that disclosed in either the preferred or alternate embodiments. In addition, the angular orientation of the pin rake conveyor assemblies and the abrading devices may be different than that shown. For example, it is contemplated that the pin rake conveyor assemblies may be oriented angular with respect to the horizontal such that the workpiece is transported along a sloping surface of the conveyor. It is further contemplated that the angular orientation of the pin rake conveyors may be substantially vertical with a substantially parallel orientation of the abrading devices. Moreover, other devices may be used in combination with the pin rake conveyor assembly for flipping workpieces to expose a different surface to be worked upon. These and other modifications can be made without departing from the spirit or scope of the invention as defined by the appended claims.

The embodiments of the invention in which an exclusive property or privilege is claimed are defined as follows:

1. An apparatus for abrading a workpiece, comprising in combination:

a conveyor for moving the workpiece from a first position to a second position;

a first assembly, intermediate said first and second positions and opposite said conveyor, for abrading one side of the workpiece in a first direction; and a second assembly, intermediate said first and second positions and opposite said conveyor, for abrading said one side of the workpiece in at least one direction different than said first direction.

2. The apparatus as defined in claim 1, further including a conveyor belt on said conveyor and having a plurality of retractable pins extending from said conveyor belt for engaging an opposite side of the workpiece and fixing the workpiece relative to said conveyor belt.

3. The apparatus as defined in claim 2, wherein said conveyor belt is a continuous loop conveyor belt.

4. The apparatus as defined in claim 2, wherein at least one of said first and second assemblies includes a continuous loop abrasive belt, a portion of which is parallel and opposite to said conveyor belt.

5. The apparatus as defined in claim 2, wherein at least one of said first and second assemblies includes an abrasive disk having an abrasive surface facing and parallel to said conveyor belt.

6. The apparatus as defined in claim 2, further including a magnetic device for attracting said one side of the workpiece toward at least one of said first and second assemblies for abrading said one side of the workpiece.

7. The apparatus as defined in claim 6, further including an assembly for cooling the workpiece as it passes said first and second assemblies.

8. The apparatus as defined in claim 7, further including a filtration assembly for removing cuttings abraded from the workpiece.

9. The apparatus as defined in claim 8, further including:

a second conveyor located at said second position and spaced opposite said first conveyor for moving the workpiece from said second position to a third position; and a third assembly located opposite said second conveyor and adjacent said first conveyor for abrading a side of the workpiece opposite said one side.

10. The apparatus as defined in claim 8, further including a probe interconnected to said first conveyor for setting a height of said first conveyor above said first and second assemblies for abrading the workpiece.

11. The apparatus as defined in claim 8, further including a mist collector attached to the apparatus for creating a negative pressure within the apparatus and reducing a discharge of liquid therefrom.

12. The apparatus as defined in claim 8, wherein said conveyor belt is a continuous loop conveyor belt.

13. The apparatus as defined in claim 12, wherein at least one of said first and second assemblies includes a continuous loop abrasive belt, a portion of which is parallel and opposite to said conveyor belt.

14. The apparatus as defined in claim 13, wherein at least one of said first and second assemblies includes an abrasive disk having an abrasive surface facing and parallel to said conveyor belt.

15. The apparatus as defined in claim 1, further including a magnetic device for attracting said one side of the workpiece toward at least one of said first and second assemblies for abrading said one side of the workpiece.

16. The apparatus as defined in claim 1, further including an assembly for cooling the workpiece as it passes said first and second assemblies.

17. The apparatus as defined in claim 1, further including a filtration assembly for removing cuttings abraded from the workpiece.

18. The apparatus as defined in claim 1, further including:

a second conveyor located at said second position and spaced opposite said first conveyor for moving the workpiece from said second position to a third position; and a third assembly located opposite said second conveyor and adjacent said first conveyor for abrading a side of the workpiece opposite said one side.

19. The apparatus as defined in claim 1, further including a probe interconnected to said first conveyor for setting a height of said first conveyor above said first and second assemblies for abrading the workpiece.

20. The apparatus as defined in claim 1, further including a mist collector attached to the apparatus for creating a negative pressure within the apparatus and reducing a discharge of liquid therefrom.

21. An apparatus for abrading a workpiece, comprising in combination:

at least one continuous loop conveyor belt assembly having a plurality of biased fingers extending outwardly therefrom for contacting the workpiece and translating the workpiece generally a length of the apparatus from an input position to an output position;

a first abrasive assembly, intermediate said input and output positions and opposite said at least one continuous loop conveyor belt assembly, for abrading the workpiece in a first direction as said at least one continuous loop conveyor belt assembly is translating the workpiece from said input position toward said output position; and a second abrasive assembly, opposite said at least one continuous loop conveyor belt and intermediate said input and output positions, for abrading the workpiece in a direction different than said first direction as said at least one continuous loop conveyor belt assembly is translating the workpiece from said input position toward said output position.

22. The apparatus for abrading a workpiece as defined in claim 21, further including a mist collection device in fluid communication with said at least one continuous loop conveyor belt assembly and said first and second abrasive assemblies for collecting mist particles and returning them to an interior of the apparatus.

23. The apparatus for abrading a workpiece as defined in claim 21, further including a lubricating coolant assembly for circulating a lubricating coolant over the workpiece and over and through said at least one continuous loop conveyor belt assembly and the first and second abrasive assemblies.

24. The apparatus for abrading a workpiece as defined in claim 23, further including a filtration assembly in fluid communication with said lubricating coolant assembly for filtering and cleaning said lubricating coolant.

25. The apparatus for abrading a workpiece as defined in claim 21, further including a height adjusting assembly interconnected to said at least one continuous loop conveyor belt assembly for setting a height of said at least one continuous loop conveyor belt assembly with respect to said first and second abrasive assemblies.

26. The apparatus for abrading a workpiece as defined in claim 25, wherein said height adjusting assembly includes a probe extending above a reference surface for setting a height of said at least one continuous loop conveyor belt assembly with respect to an upper surface of said first and second abrasive assemblies.

27. The apparatus for abrading a workpiece as defined in claim 21, wherein said at least one continuous loop conveyor belt assembly includes:

a conveyor frame assembly;

a first and second sprocket assembly disposed at opposite ends of said conveyor frame assembly, said first sprocket assembly connected to a conveyor drive assembly;

two chain link loops mounted on and engaging said first and second sprocket assemblies; and a plurality of pin rake bar assemblies extending between and interconnecting said two chain link loops and mounted thereon for movement with said two chain link loops between said first and second sprocket assemblies.

28. The apparatus for abrading a workpiece as defined in claim 21, wherein said first abrasive assembly includes a continuous loop abrasive belt mounted in rotating relationship on a roller assembly and having a portion of said continuous loop abrasive belt paralleling a portion of one side of said at least one continuous loop conveyor belt assembly for abrading a surface of the workpiece conveyed by said at least one continuous loop conveyor belt assembly in said first direction.

29. The apparatus for abrading a workpiece as defined in claim 28, wherein said roller assembly includes:

two frame members;

a drive roller mounted between said frame members;

a plurality of tracking rollers mounted between said frame members and proximate one edge thereof;

an idler roller mounted in sliding relationship to said frame members; and a continuous abrasive belt mounted around said drive roller, said tracking rollers, and said idler roller, for moving said continuous abrasive belt in said first direction.

30. The apparatus for abrading a workpiece as defined in claim 21, wherein said second abrasive assembly includes a disk having an abrasive upper surface configured to rotate about an axis generally concentric with said disk and oriented generally perpendicular to said at least one continuous loop conveyor belt assembly for abrading the workpiece in at least one direction different than said first direction.

31. An apparatus for deburring a workpiece, comprising:

a first conveyor for transporting the workpiece from a staging position to a first position;

a second conveyor for transporting the workpiece from said first position to a second position;

a third conveyor for transporting the workpiece from said second position to an output position;

a first deburring device, intermediate said first and second positions and opposite said second conveyor, for deburring the workpiece in a first direction; and a second deburring device, intermediate said first and second positions and opposite said second conveyor, for deburring the workpiece in at least a second direction.

32. The apparatus for deburring a workpiece as defined in claim 31, further including a third deburring device intermediate said second position and said output position and opposite said third conveyor for deburring an opposite side of the workpiece in at least one direction.

33. The apparatus for deburring a workpiece as defined in claim 31, further including a lubricating system for circulating a lubricating coolant onto the workpiece and over said conveyors and deburring devices for cleaning debris therefrom and aiding in the deburring process.

34. The apparatus for deburring a workpiece as defined in claim 31, further including a device attached to said second conveyor for adjusting a height of said second conveyor relative to said first and second deburring devices.

35. The apparatus for deburring a workpiece as defined in claim 31, wherein said first conveyor is defined by an inlet conveyor having a porous conveyor belt extending around a roller located proximate a point exterior the apparatus at said staging position around another roller located at said first position within the apparatus for transporting the workpiece from said staging position to said second conveyor.

36. The apparatus for deburring a workpiece as defined in claim 31, wherein said second conveyor includes a plurality of pin rake bar assemblies interconnecting two spaced apart chain loops mounted on at least two sprocket assemblies, said sprocket assemblies located proximate an opposite end of said second conveyor and mounted to a conveyor frame.

37. The apparatus for deburring a workpiece as defined in claim 31, wherein said first deburring device includes a continuous loop abrasive belt mounted on at least two rollers and oriented with respect to said second conveyor such that a portion of the continuous loop abrasive belt is adjacent and parallel to said second conveyor.

38. The apparatus for deburring a workpiece as defined in claim 31, wherein said second deburring device includes an abrasive pad mounted to a surface of a disk adjacent and parallel to said second conveyor.

39. The apparatus for deburring a workpiece as defined in claim 31, further including a device mounted on the apparatus for creating a negative pressure within the apparatus and substantially retaining particulates within the apparatus.

40. A method for automatically deburring a workpiece, comprising in combination, the steps of:

conveying the workpiece from a first position to a second position;

abrading in at least a first direction, a surface of the workpiece using a first abrasive medium during the conveying step intermediate the first and second positions; and abrading in at least a second direction, the surface of the workpiece using a second abrasive medium during the conveying step intermediate the first and second positions.

41. The method as defined in claim 40, further comprising the steps of positively urging the surface of the workpiece toward at least one of said first and second abrasive mediums during the abrading steps.

42. The method as defined in claim 41, wherein the step of positively urging includes the step of attracting the surface of the workpiece toward at least one of said first and second abrasive mediums during the abrading steps.

43. The method as defined in claim 42, wherein the step of attracting includes magnetically attracting.

44. The method as defined in claim 42, wherein the step of positively urging includes the step of pushing the workpiece toward at least one of said first and second abrasive mediums during the abrading steps.

* * * * *